United States Patent [19]

Paraskevakos et al.

[11] Patent Number: 4,858,743

[45] Date of Patent: Aug. 22, 1989

[54] VENDING MACHINE AND METHOD FOR AUTOMATIC VENDING AND RETURNING OF MERCHANDISE, PARTICULARLY VIDEO CASSETTE TAPES

[75] Inventors: T. G. Paraskevakos, Melbourne, Fla.; J. P. Paris, Baltimore, Md.

[73] Assignee: DataVend, Inc., Baltimore, Md.

[21] Appl. No.: 80,571

[22] Filed: Jul. 31, 1987

[51] Int. Cl.[4] ..... G07F 7/10; G07F 11/16

[52] U.S. Cl. ..... 194/205; 221/88; 221/195; 414/280; 414/661

[58] Field of Search ..... 194/205; 221/1, 5, 87, 221/88, 66, 123, 134, 195, 258, 262, 268; 186/55, 56; 414/280, 281, 417, 661, 273; 235/381, 383, 385

[56] References Cited

U.S. PATENT DOCUMENTS

| | | | |
|---|---|---|---|
| 1,244,889 | 10/1917 | Patterson | 221/134 |
| 3,504,808 | 4/1970 | Carabateas | 414/280 X |
| 4,414,467 | 11/1983 | Gould et al. | 235/381 |
| 4,458,802 | 7/1984 | Maciver et al. | 194/205 |
| 4,519,522 | 5/1985 | McElwee | 221/13 |
| 4,598,810 | 7/1986 | Shore et al. | 194/205 |
| 4,668,150 | 5/1987 | Blumberg | 221/88 X |
| 4,734,005 | 3/1988 | Blumberg | 221/88 X |

FOREIGN PATENT DOCUMENTS

| | | | |
|---|---|---|---|
| 0184527 | 6/1986 | European Pat. Off. | 194/205 |
| 0191636 | 8/1986 | European Pat. Off. | 194/205 |
| 8602758 | 5/1986 | World Int. Prop. O. | 221/88 |
| 8604173 | 7/1986 | World Int. Prop. O. | 194/205 |

*Primary Examiner*—Joseph J. Rolla
*Assistant Examiner*—Edward S. Ammeen
*Attorney, Agent, or Firm*—Antonelli, Terry & Wands

[57] ABSTRACT

An apparatus for and method of automatically vending merchandise to a patron, with the apparatus including display devices and input devices for interaction with the patron. At least one motor is provided for providing vertical and horizontal movement to an elevator which accesses the stored merchandise from respective column positions within the machine. The elevator is then returned to a NEUTRAL position and the merchandise is dumped or dispensed to the patron. The system can provide RENTAL, PURCHASE or RETURN of merchandise procedures along with various other functions related to vending operations.

56 Claims, 31 Drawing Sheets

VENDING MACHINE AND METHOD FOR AUTOMATIC VENDING AND RETURNING OF MERCHANDISE, PARTICULARLY VIDEO CASSETTE TAPES

BACKGROUND OF THE INVENTION

The present invention relates generally to a machine for automatic vending of merchandise to a patron and, more particularly, to a machine for vending, for example, video cassette tapes, photographic film or any other type of merchandise which requires vending.

A number of systems for vending merchandise are commercially available, however, these systems are extremely complicated and extremely costly. For example, in U.S. Pat. No. 4,598,810, a vending unit is proposed which includes a plurality of cubicles therein. Upon interaction through an input device with a patron, the system controller causes a motor and gear configuration to position an ejecting unit at the proper dispensing location. A disadvantage of this system resides in the fact that the ejecting unit requires a complicated control function to release the merchandise from a release-spring within each cubical, therefore, the system is mechanically and electronically complicated, hence, quite costly and subject to mechanical breakdown.

In, for example, U.S. Pat. No. 4,458,802 another example of an automatic vending machine is proposed wherein a motor driven carousel rotates corresponding to an input code to locate the proper merchandise at a dispense position. A disadvantage of this proposed system recites in the fact that due to the use of the carousel, the system is physically bulky and cannot store a large number of items to be dispensed.

U.S. Pat. No. 4,414,467 also proposes an automatic vending machine, however, a disadvantage of this system resides in the fact that this system is extremely costly and complicated because it requires a motor for accessing every column of merchandise in order to vend the merchandise to the patron.

The aim underlying the present invention resides in avoiding the above-noted disadvantages of the prior art by providing a vending apparatus which is electronically and mechanically simplified so as to provide a low cost, efficient, low maintenance vending device.

For this purpose, according to the present invention, the machine is proposed having the ability to access a large quantity of merchandise stored in a relatively small area, with the accessing device being required to move in only two directions in the same plane thereby enabling the control of the accessing device to be considerably less complicated than that in the prior art.

In accordance with the advantageous features of the present invention, a vending machine is provided which includes a simple mechanical elevator comprising a transferring fork and service platforms attached thereto for accessing the storage columns. The elevator moves vertically along the stored merchandise which is stored on shelves in a plurality of columns with the service platform traveling between respective ones of the columns. The merchandise is transferred between the storage shelves and the service platforms by the transferring fork which moves horizontally along the elevator. The merchandise is always brought to the same NEUTRAL position before it is dispensed by tilting the elevator to the patron.

By virtue of the above-noted features of the present invention, it is possible to realize a mechanically and electronically simplified, low cost automatic vending machine.

DETAILED DESCRIPTION

Figure 1:
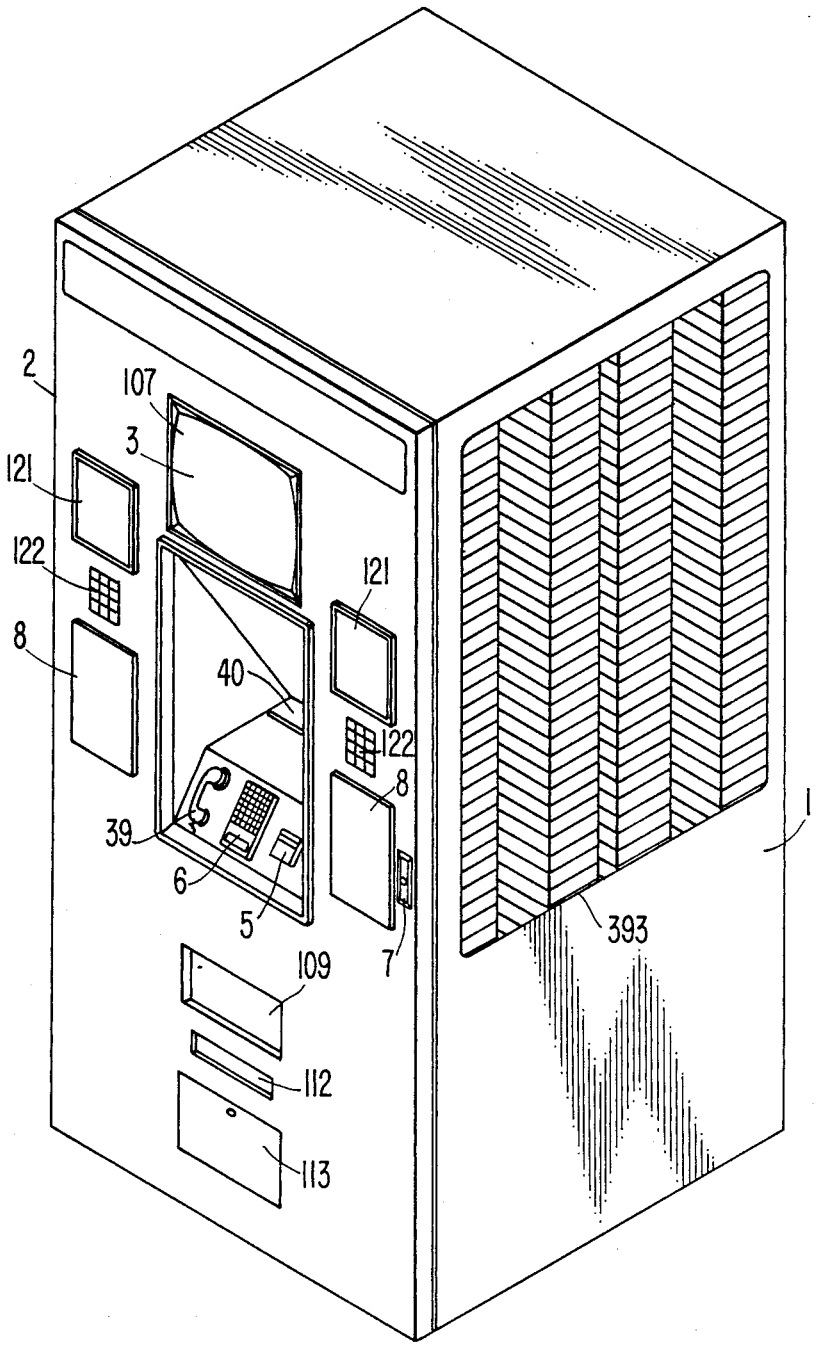
FIG. 1 is an overall external view of the present invention.
Figure 4:
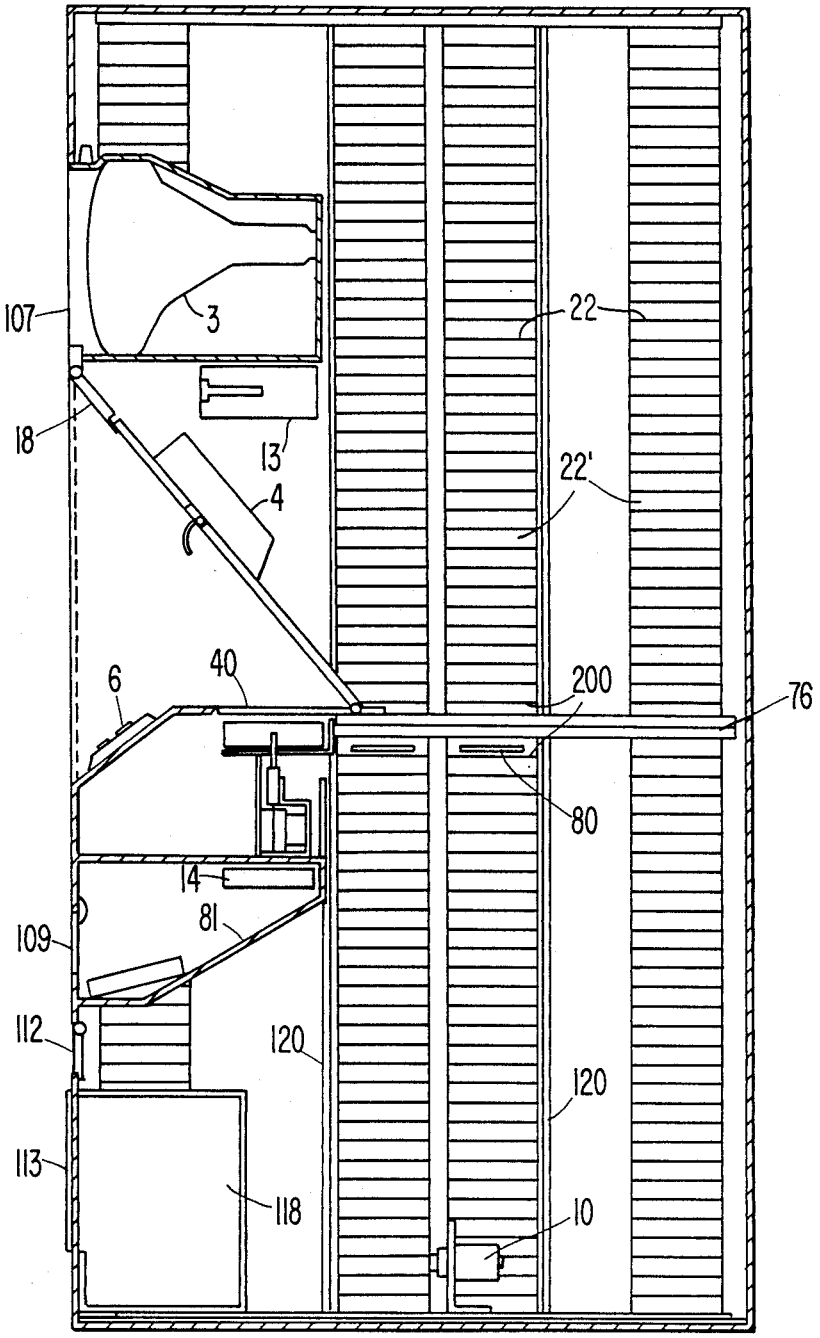
FIG. 4 is a side view of the machine of the present invention.
Figure 5:
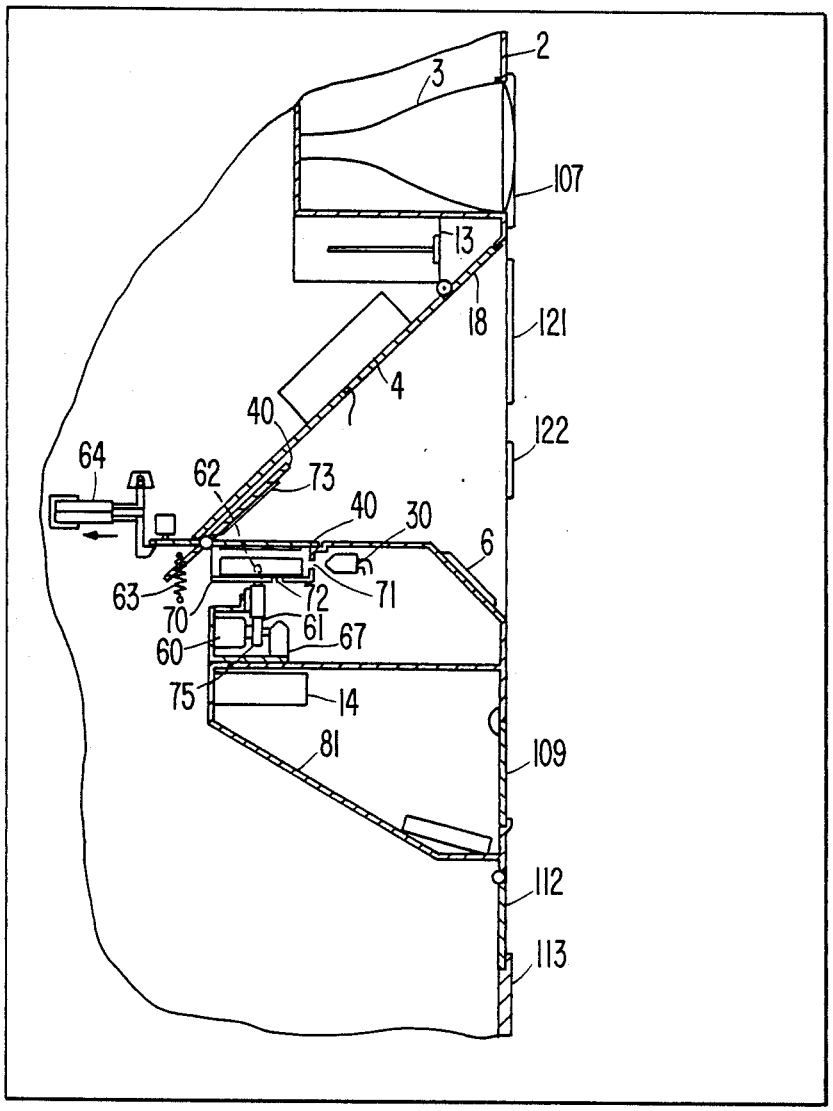
FIG. 5 is a side view showing details of the mechanical and electronic components for providing a RETURN operation.

Referring now to the drawings wherein like reference numerals are used throughout the various views to designate like parts and, more particularly, to FIG. 1, a vending machine in accordance with the present invention includes a cabinet 1 for enclosing the overall system on the sides and the rear and a front door 2 hinged to the cabinet 1 for opening and closing such that an operator can gain access to the machine, with a security lock 7 being provided for enabling a securing of the door to the cabinet 1. The cabinet 1 is also provided on respective lateral sides with a transparent window arrangement 393 for enabling visual inspection of the merchandise therein and for enabling an inspection of any possible malfunctions of the machine and a visual inspection of the inventory of the machine. A display 3 is provided within the machine and an opening is provided in the door for the viewer to observe the display 3. The display 3 provides step-by-step instructions for the patron to operate the vending machine. A keyboard 6 allows the patron to enter numeric and functional inputs to the system controller 29 with functions of the keyboard including, but are not limited to, RENT, RETURN, HELP, CANCEL, MEMBERSHIP, BUY, PHOTODEVELOP, O. K., ENGLISH, OTHER LANGUAGE (Spanish, French, etc.). The keyboard 6 can provide any other functions related to the operation of the machine. Alternatively, a touch screen 107 can be used instead of the keyboard 6 to provide the functional input instructions by the patron. An access mechanism 5, for example, an insert mechanism 5 is provided for accommodating, for example, a credit card or other authorized access device to allow the patron to operate the machine using either a specifically assigned card or one of the many commercially available credit cards. Thus, the patron's credit and/or membership information is conveyed to the system controller 29 through, for example, the magnetic strip of the card or other access device. A printer 4, as shown in FIGS. 4 or 5, provides the patron with a receipt of the transaction with the machine.

At least two windows 8 are provided in the front of the machine to display lists of the merchandise available for vending and also for displaying instructions on how to operate the machine. In addition to the display windows 8, additional displays 121, such as CRTs for example, are provided and are operated by corresponding keyboards 122 which allow the patron to review the present inventory of the machine or instructions on how to use the machine. Each display 121 and corresponding keyboard 122 can be used independently of the other thereby enabling more than one patron to review the merchandise at the same time or while another patron is using the machine.

At least one article of merchandise to be returned is inserted by the patron to the receptacle port (see FIG. 5) by operating the hatch 40 and the merchandise is dispensed to the patron by opening the flap 109. As can be appreciated, the receptacle port can be dimensioned so that a stack of merchandise may be inserted therein with appropriate means (not shown) being provided for automatically returning the respective articles of merchandise to controller assigned positions. If the machine is to be used to vend photographic film, the film to be developed can be deposited through the film receptacle 112 and a door 113, in the front of the machine, allows the film developer to retrieve the film to be developed from a basket 119 (see FIG. 4) contained within the machine. To facilitate handling of the film to be developed, it is also possible to provide, for example, a barcoded, or other identifying means, container device for accommodating undeveloped photographic materials to subsequently be processed, with appropriate control means being provided on the container, thereby facilitating the re-insertion of the photographic material into the machine, subsequent to development.

Figure 12:
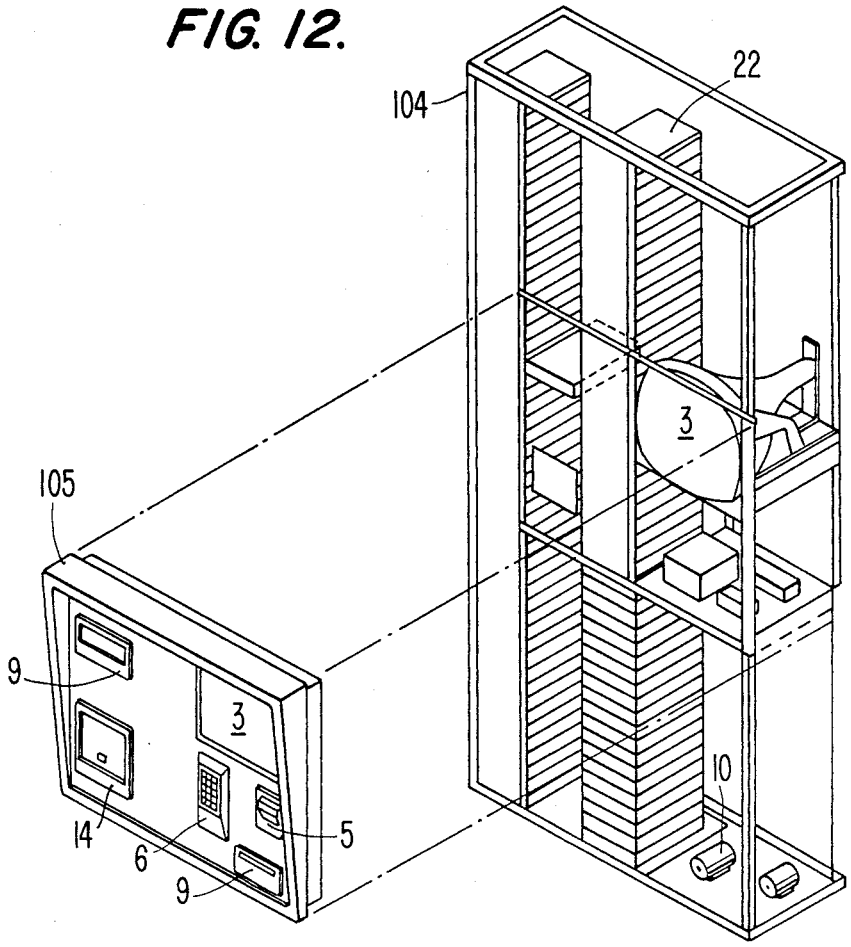
FIGS. 12 and 13 show an alternative embodiment of the present invention.
Figure 13:
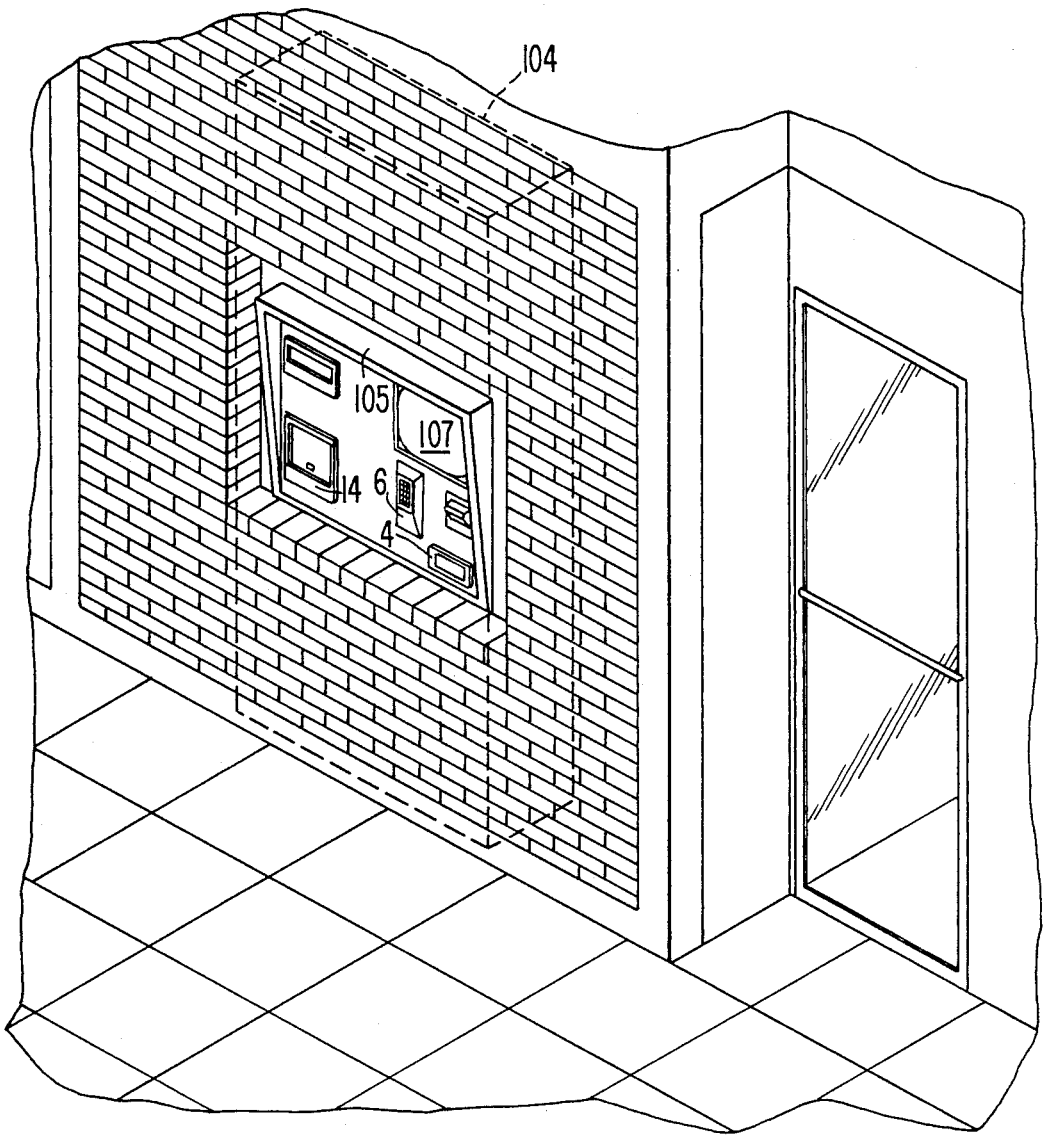

FIGS. 12 and 13 show an alternative embodiment of the present invention which is modified such that the machine can be disposed behind an exterior wall of a building with an opening therein for access of the functional components needed by the patron to operate the machine.

FIG. 4 is a side-view of the machine with the exterior cabinet 1 deleted and wherein the merchandise for vending is video cassette tapes. For purposes of description, it will be assumed, henceforth, that the merchandise to be dispensed is video cassette tapes (tapes). As shown, the tapes are arranged in four columns A–D starting from the front of the machine to the rear of the machine.

Figure 2:
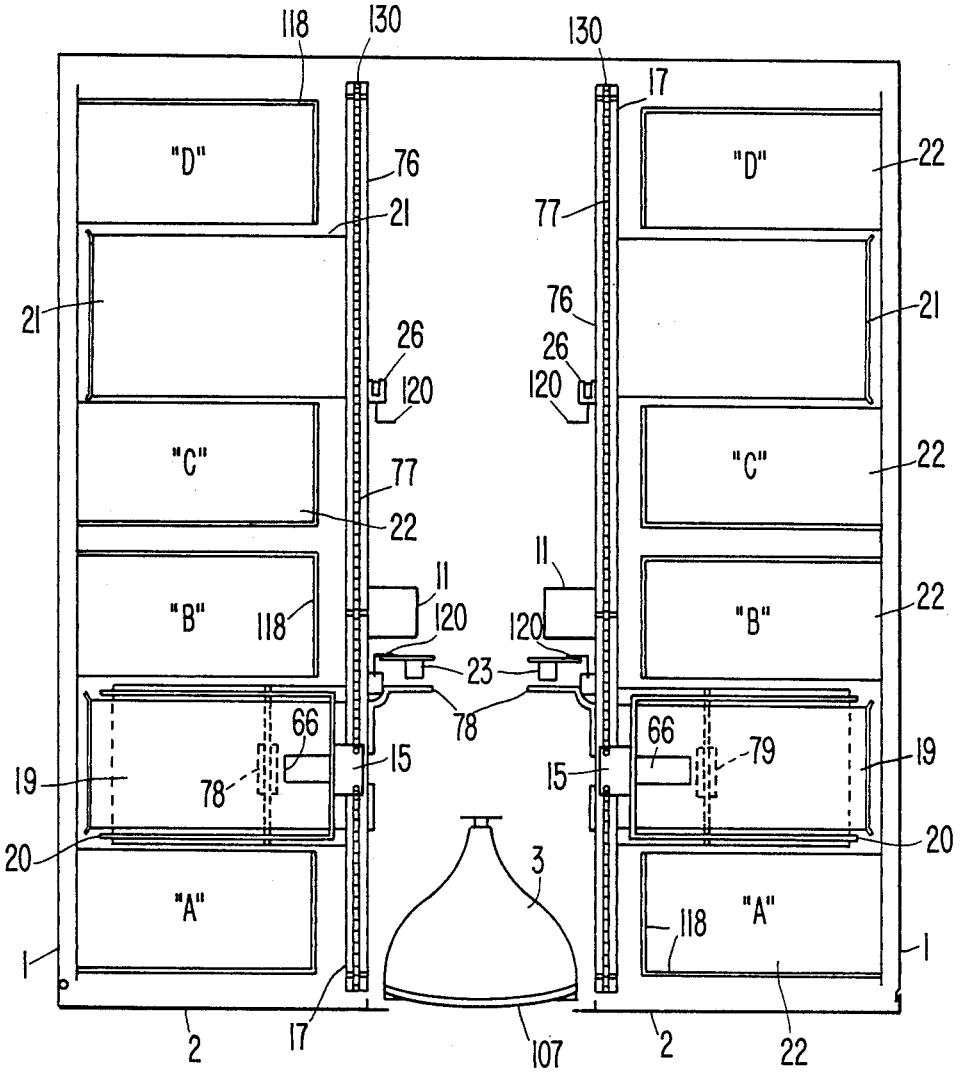
FIG. 2 is a detailed view from the top of the machine which shows a plurality of storage columns A–D and the horizontal accessing device of the elevator for accessing the columns.
Figure 3:
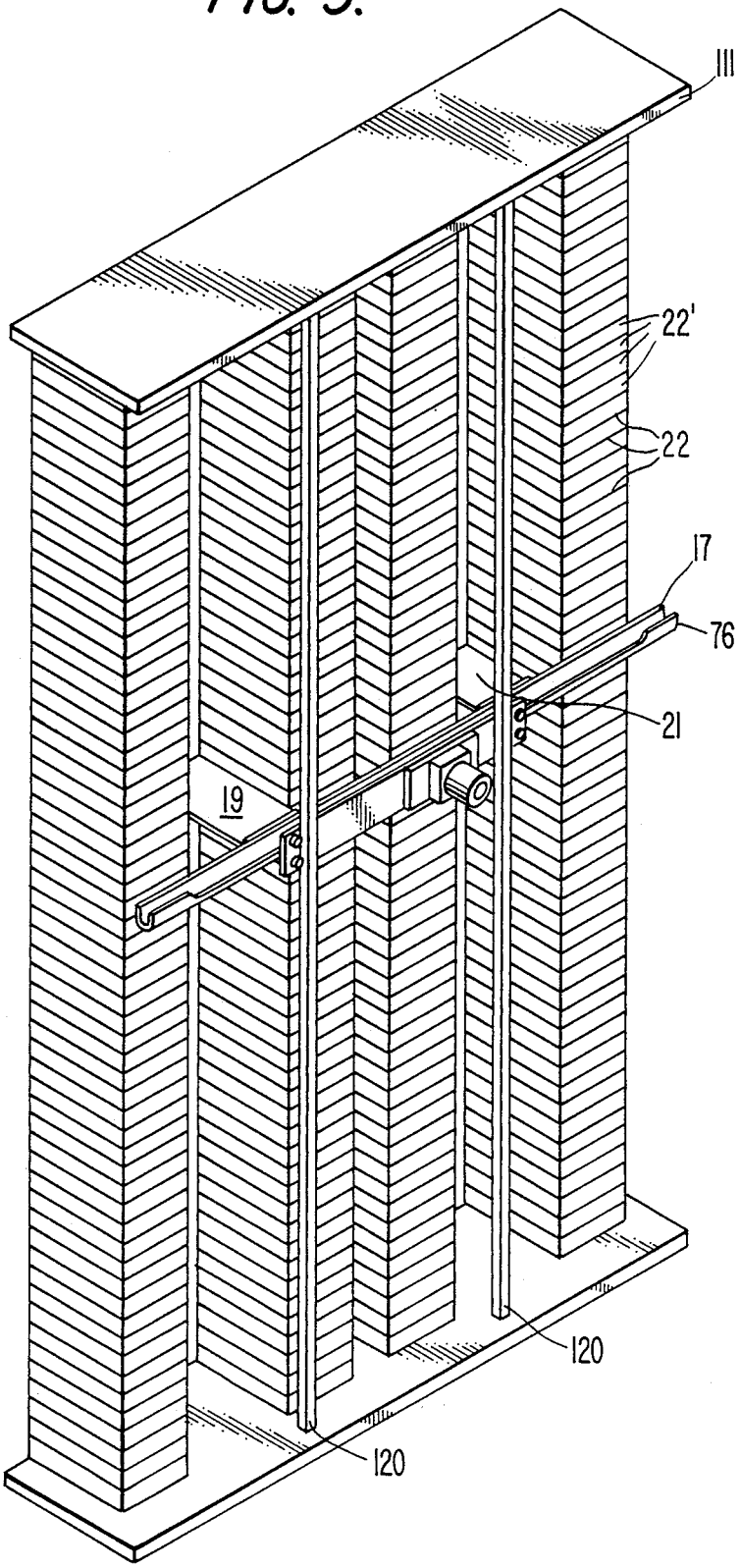
FIG. 3 illustrates a plurality of columns of merchandise and the elevator for moving vertically between the columns.

Referring to FIG. 3, each set of columns A–D of tapes comprises a module 111 and, as shown in FIG. 2, in this embodiment, there is a module of tapes on both the left and the right side of the display 3 in the machine. While FIGS. 3 and 4 tend to show that the tapes are stacked on top of one another, in actuality the tapes in the columns are resting on individual shelves, which are not illustrated in FIGS. 3 and 4 for the sake of clarity. Therefore, there is actually a space or gap in between the tapes 22' since they are resting on their respective shelves 22, more clearly illustrated in FIG. 9*b*. As shown, each layer of shelves 22 in the respective columns A–D comprises a single, preformed unit which includes the individual four shelves 22 corresponding to the columns A–D. Each unit of shelves 22 is stacked on top of each other and is supported on one side by angle irons 117 and iron C-shaped channels 133. The shelves 22 include a retaining lip 118 and can be made from any suitable material which allows them to be rigid and withstand the maximum weight of up to two pounds such as, for example, injection molded plastic.

Referring back to FIG. 2, the mechanisms for explaining the horizontal movement of a tape along the elevator 76 to the shelves 22 will be explained. One module 111 (FIG. 3) is provided on either side of the machine with the display 3 in between and the operation is similar on either side. As shown, each elevator 76 includes a service platform 21 provided between columns C and D and a service platform 19 provided between columns A and B. Both the service platforms 19 and 21 are for transferring the merchandise only and the service platform 19 is also hinged to provide an unload or dumping movement to dispense the merchandise down a chute to the patron.

FIG. 3 more clearly shows the elevator 76 including the service platforms 19 and 21, moving vertically between the respective columns, along the vertical guides 120 under the operation of a vertical drive motor 10.

Referring back to FIG. 2, rollers 26 are provided on the elevators 76 which engage with the vertical guides 120 for movement therealong upon energization by the vertical drive motor 10. In addition to the service platforms 19, 21, a transferring fork 20 is attached at 15 to a chain belt 77 on the elevator 76. The chain belt 77 is driven by horizontal motor 11 which causes the transferring fork 20 to be moved horizontally along the shelves from shelf A to D and back again. Thus, if the tape is on the service platform 19 and must go to shelf B, for example, since the transferring fork 20 is on either side of the tape, the horizontal drive motor rotates the chain belt 77 counter-clockwise and the tape is moved from the service platform 19 onto the shelf 22 in column B. As can be appreciated by those or ordinary skill in the art, it is possible to utilize an acme screw, a worm gear arrangement or a rack and pinion in lieu of the chain belt 77.

As previously stated, there is only a small gap between each set of shelves which are stacked vertically. Accordingly, as shown in FIG. 4, there is a space 200 where no shelves exist in columns B and C so that the transferring fork 20 can pass from column A along the elevator 76 to column D to reach all the shelves 22. Disposed within the space 200 are two transfer platforms 80 (FIG. 9*a*) across which the merchandise can slide such that the transferring fork 20 can move the merchandise back and forth between the service platforms 19 and 21 across the transfer platforms 80 depending on whether the machine is dispensing or returning a tape. These transfer platforms 80 can be made from any suitable material which allows them to be rigid and withstanding maximum weight of up to two pounds. In the present example, these transfer platforms 80 are made from the same injection molded plastic as the shelves 22. They are held together by a bracket 134 which is supported by the angle iron 117 and the iron C-shaped channels 132 which also support the molded shelf units. The end of the transfer platforms 80 includes a retaining lip 118 similar to that of the shelves 22. However, the sides of the transfer platforms 80 do not have any retainer lips so that the merchandise can freely travel across both of the transfer platforms 80.

The vertical location for the elevator corresponding to the gap 200 and transfer platforms 80 is the NEUTRAL position and only when the elevator 76 is in this NEUTRAL position can the transferring fork 20 more horizontally between the two service platforms 19 and 21. Accordingly, before a tape form columns C or D can be "dumped" by the service platform 19, the elevator 76 must return to the NEUTRAL position so that the transferring fork 20 can transfer the tape from the service platform 21 across the transfer platforms 80, to the service platform 19, which is hinged for dumped the tape. Likewise, the elevator begins an access from this NEUTRAL position so as to move the transferring fork 20 horizontally before moving vertically. In addition, the elevator 76 always returns to the NEUTRAL position after returning a tape.

Figure 7A:
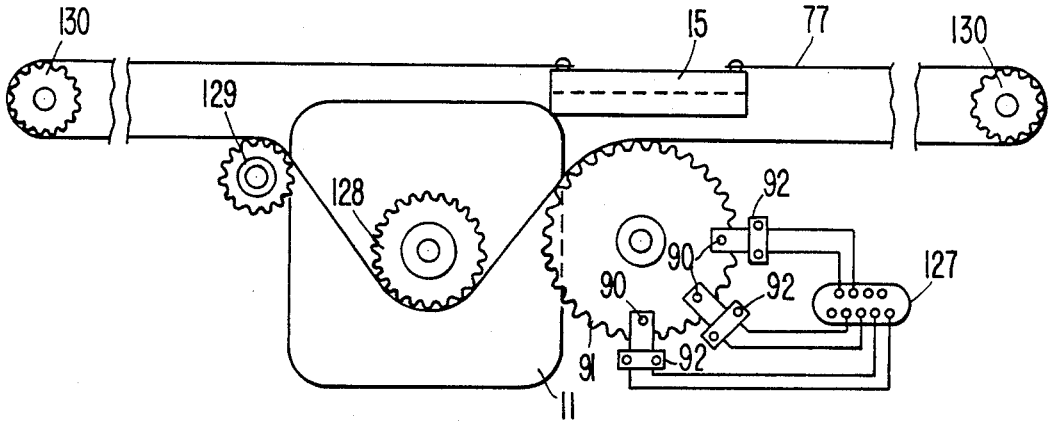
FIG. 7*a* shows a horizontal mechanism for providing horizontal movement of the merchandise along the elevator and a position decoding mechanism related thereto.
Figure 7:
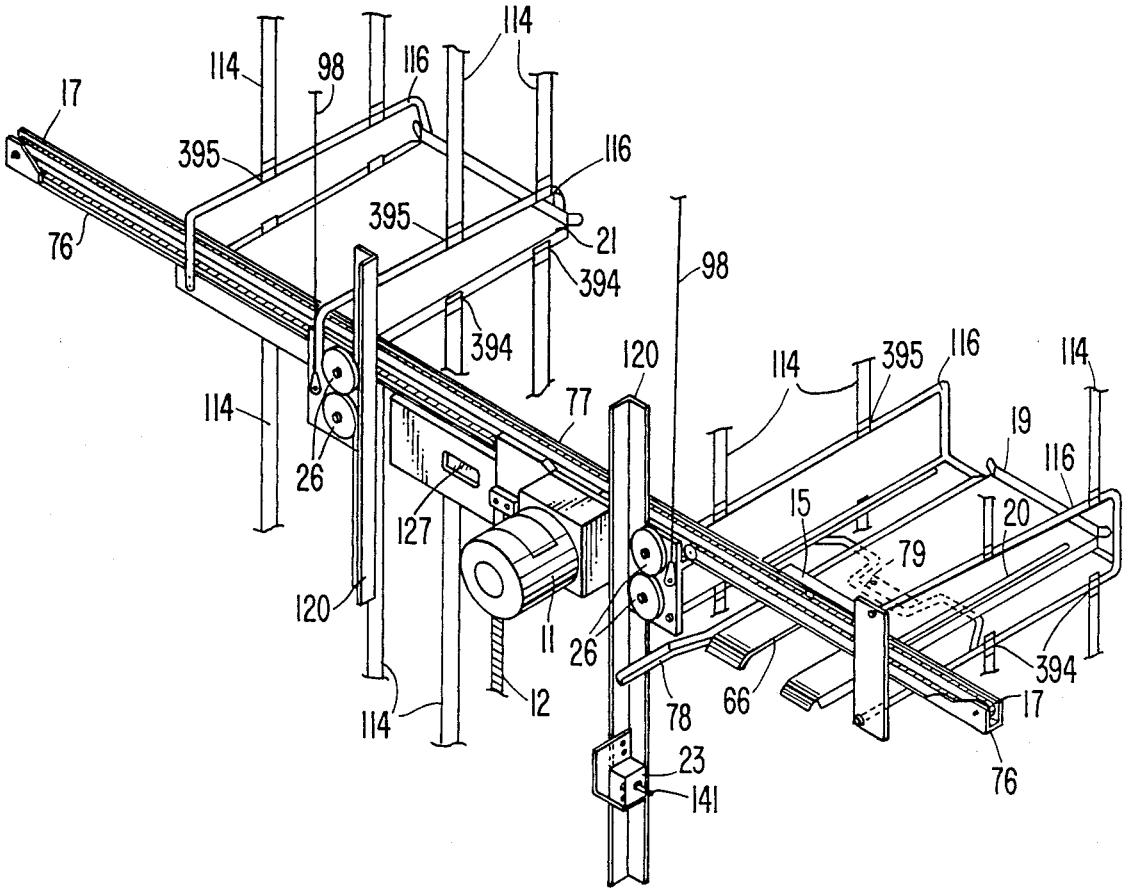
FIG. 7 illustrates the elevator which moves vertically and the solenoid for causing the dispensing operation.

It should be further noted that in addition to returning to the service platform 19 to allow a dispensing of the merchandise, the transferring fork 20 always returns to the service platform 19, as shown in FIGS. 2 and 7, after returning a tape to a storage location. This position of the transferring fork 20 being aligned with the service platform 19 will henceforth be referred to as the HOME position since it is from this position that the tape is either dispensed from the machine or beings to be returned to its respective location in the machine.

In summary, service platforms 19 can service columns A and B, and service platform 21 can service columns C and D. In order for the transferring fork 20 to move from one service platform to another, the elevator 76 must be at the NEUTRAL position corresponding to the gap 200 in columns B and C. The elevator 76 returns to the NEUTRAL position when not performing an accessing operation and the transferring fork 20 on the elevator 76 returns to the HOME position corresponding to the service platform 19 when not providing an accessing operation.

Figure 11:
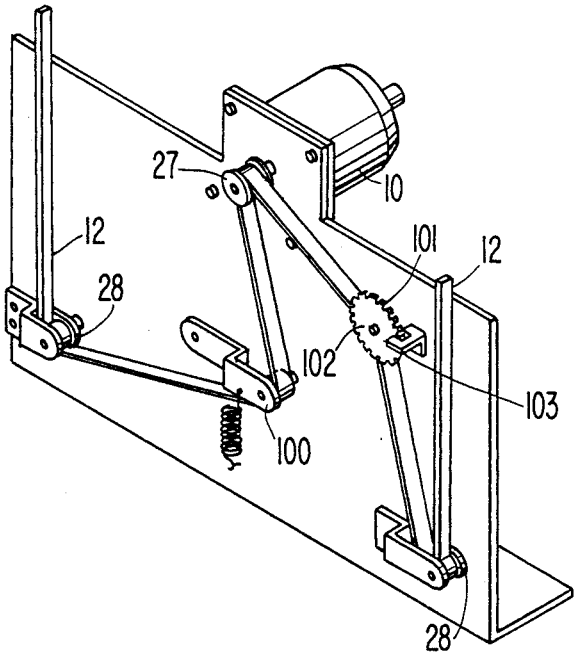
FIG. 11 shows a motor and related mechanical components for providing vertical movement to the elevator.
Figure 15:
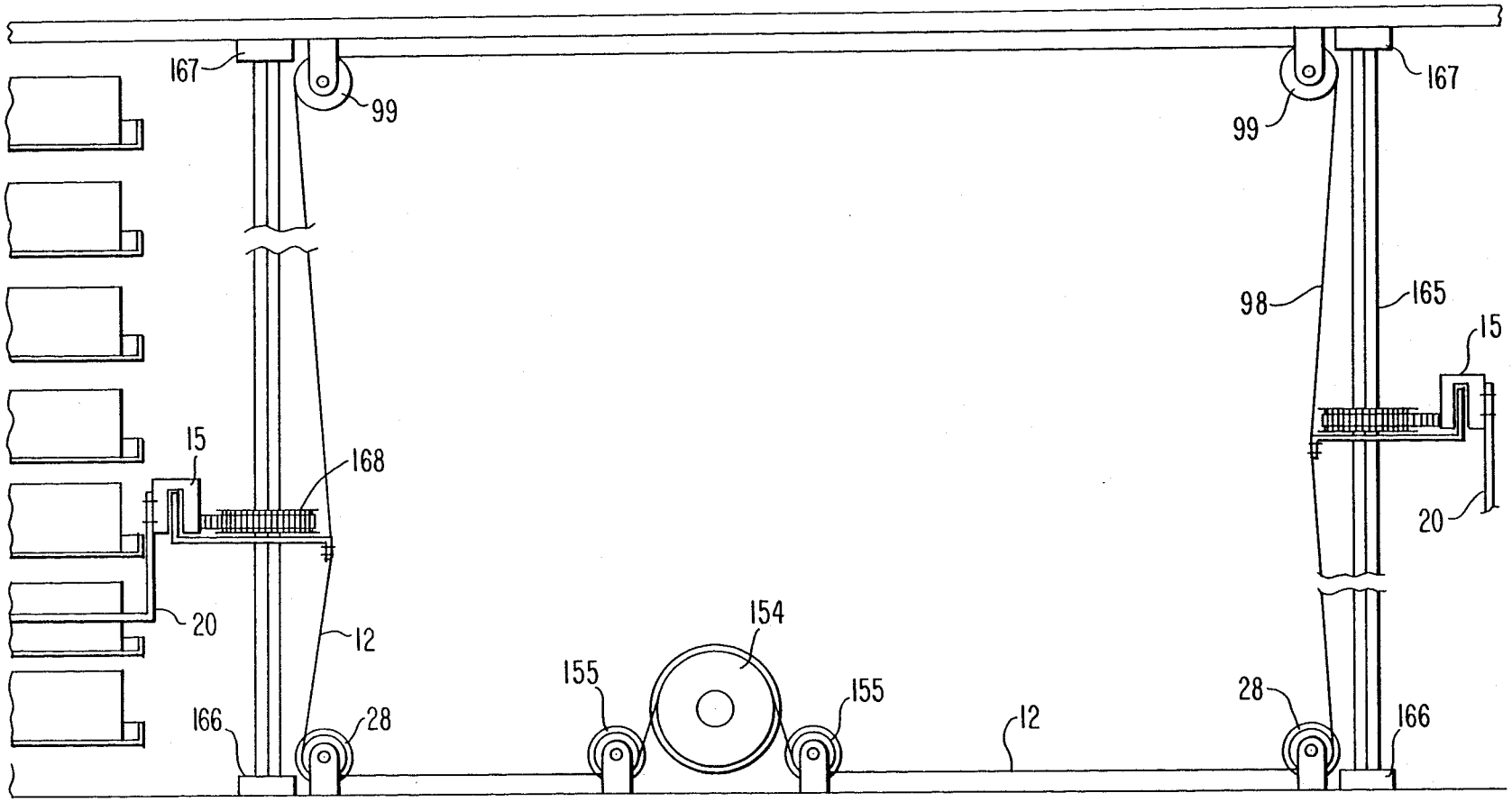
FIGS. 15 and 15*a* show mechanical components of the device shown in FIG. 14 for providing the elevator movement.
Figure 15A:
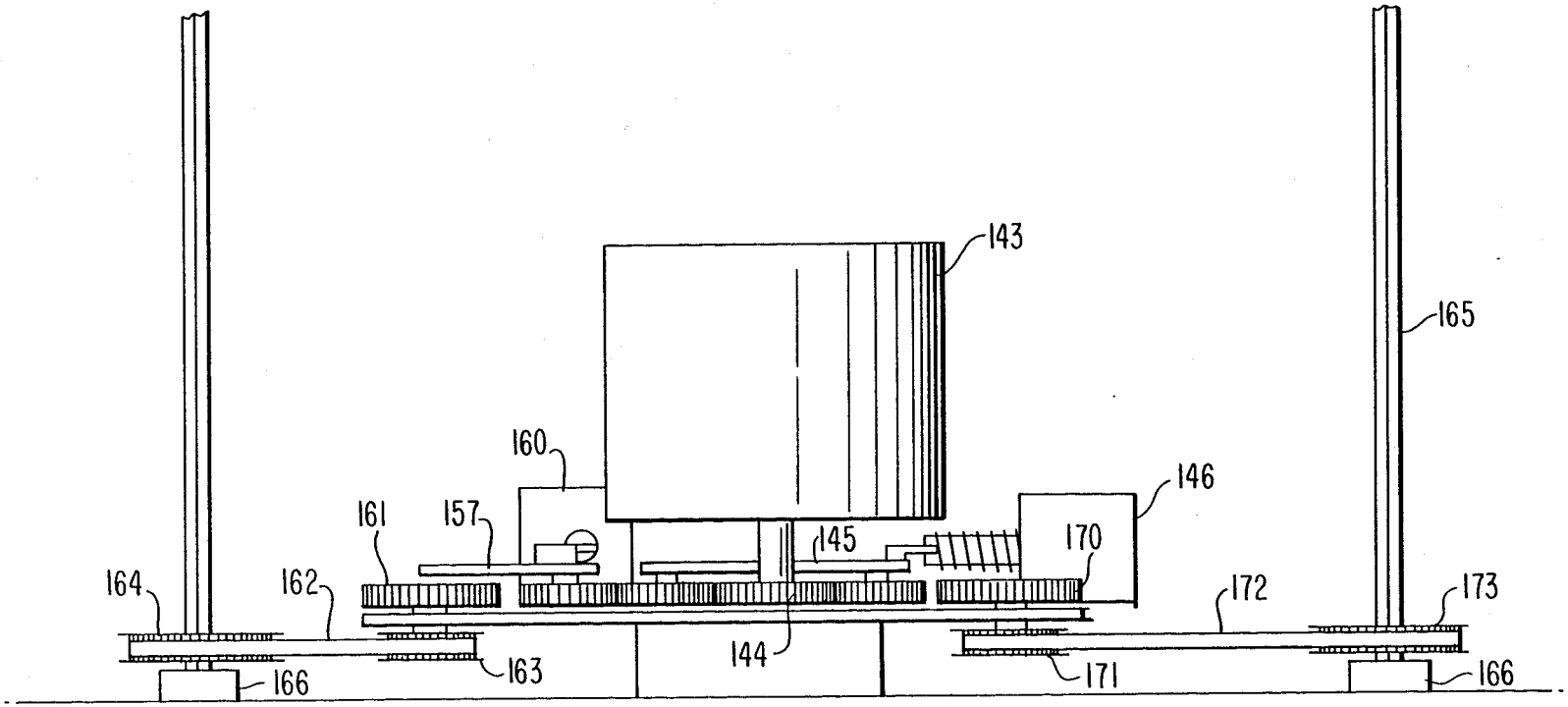

FIG. 11 shows the vertical motor 10 and the corresponding mechanism for providing vertical movement to the elevators 76. The elevators 76 corresponding to each module 111 are connected to each other through wires 98 (shown in FIGS. 15 and 7). A vertical drive timing belt 12 is connected to the elevators 76 through pulleys 28 and provides movement to the elevators from motion of the pulley 27 which is connected to the vertical motor 10. An idler 100 keeps tension on the belt 12. Thus, the elevators counter-balance each other such that when the vertical motor 10 is operated, both of the elevators 76 move vertically in opposite directions.

The interaction of the horizontal and vertical control can be shown by considering an exemplary RENT operation in connection with FIGS. 2 and 4. Upon receiving a RENT instruction from the keyboard 6, with the necessary access information (for example dispense a tape from the top of column C) the controller 29 causes the transferring fork 20 to leave the HOME position and to move horizontally under the control of the horizontal motor 11 to the vertical access position corresponding to the C column. Once the transferring fork 20 has reached this vertical access position, the controller 29 activates the vertical motor 10 to move the elevator 76 vertically to the top shelf unit. Once the elevator 76 has reaches the top shelf unit, the controller 29 causes the transferring fork 20 to move towards the service platform 21 which loads the tape from the shelf 22 to the service platform 21. Upon receiving the signal that the transferring fork 20 has moved to the service platform 21, the controller 29 activates the vertical motor 10 to cause the elevator 76 to move down to the NEUTRAL position.

Once the elevator 76 has reaches the NEUTRAL position, the controller 29 activates the horizontal motor 11 to move the transferring fork 20 towards the service platform 19 for a dispensing operation. As the transferring fork 20 moves towards the service platform 19, the tape is carried across the transfer platforms 80 and comes to rest on the service platform 19.

Once the transferring fork 20 reaches the service platform 19, the controller 29 initiates a DROP or dispense operation and activates the vertical motor 10 to cause the elevator 76 to move downward a predetermined distance. As shown in FIG. 7, once the elevator 76 reaches the predetermined distance, the controller 29 activates the solenoid 23 causing an extension 141 to protrude therefrom. In actuality, the elevator 76 is now below the solenoid 23 as opposed to above it, as shown in FIG. 7. At the same time, the controller 29 causes the elevator 76 to reverse its direction and to begin to rise towards the NEUTRAL position. As this happens, the extension 78 on the service platform 19 engages the extension 141 on the solenoid 23 causing the service platform 19 which is hinged at hinge 79 to tilt forward causing the tape to drop from the service platform through chute 81, shown in FIG. 4, to be picked up through door 109 by the patron. The elevator 76 then is stopped in the NEUTRAL position.

Figure 3A:
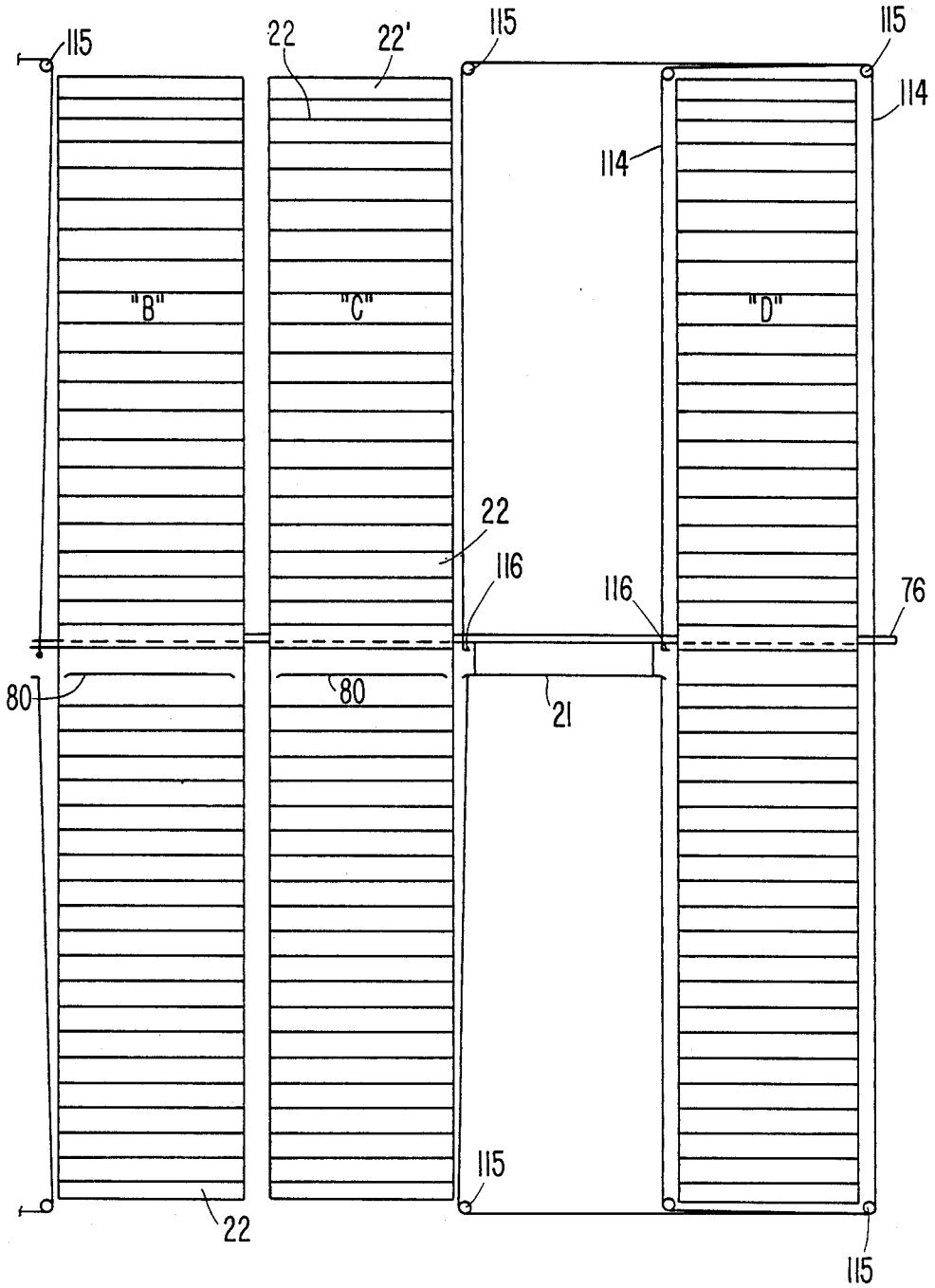
FIG. 3*a* is a schematic side view.
Figure 3B:
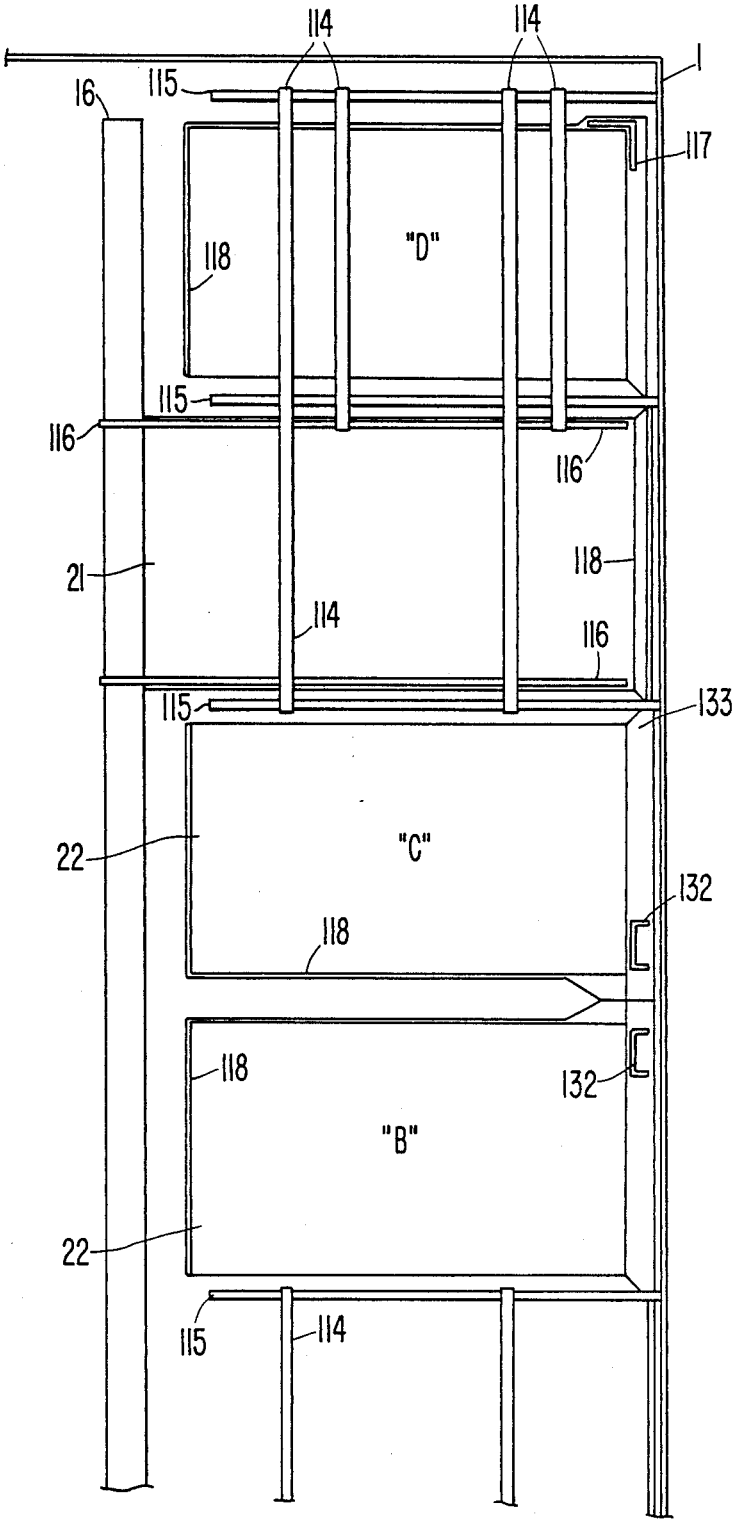
FIG. 3*b* is a top schematic plan view of the merchandise retaining belts of the plan view of FIG. 3.

FIGS. 3*a* and 3*b* show two merchandise retaining belts 114 running vertically in front of the columns of shelves 22 guided by the rollers 115. The merchandise retaining belts 114 are fastened at one end under the service platforms 19 and 21 at 394, and at the other, are fastened on top of the platforms 19 and 21 onto the rails 116 at 395 such that they allow a gap between the two ends of the belt which the merchandise can pass through.

Figure 6:
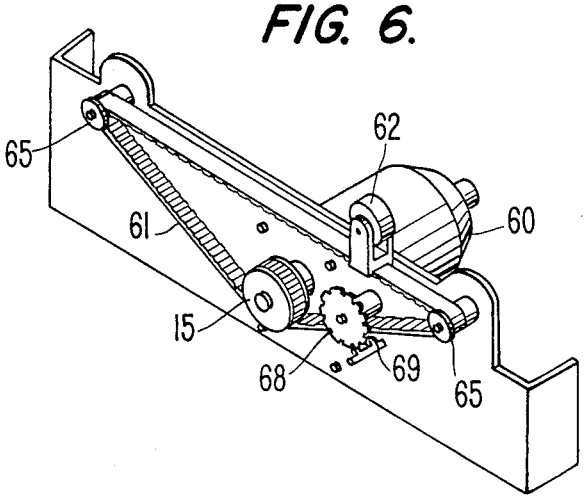
FIG. 6 shows a motor and mechanical components for moving the merchandise during a RETURN operation and shows further detail of components shown in FIG. 5.

Having described the general horizontal and vertical movements of the elevator 76, a more detailed description thereof will now be provided in the context of a RETURN operation. Referring to FIGS. 5 and 6, when the patron depresses the RETURN function button on the keyboard 6, the controllers instruct the patron to insert the patron's credit card and upon validation of the card, the controller 29 commands the solenoid 64 to release the hatch 40 which, under the operation of spring 63, will open the tape receptacle channel 70. The patron then places the returned tape into the channel 70 and manually closes the hatch 40.

A photodetector 67 is included in the channel 70 to detect whether or not the patron has inserted the tape into the channel 70. If the photodetector 67 does not receive a return signal from the mirror 73, the tape has been placed in the channel 70 and the controller 29 instructs solenoid 64 to secure the hatch 40. If no tape is placed in the channel 70, a reflection of the signal from the mirror 73 will trigger the photodetector 67 and the controller 29 will issue a new set of instructions advising the patron to place the tape in the channel 70. While the present description refers to a photodetector 67 and mirror 73 for detecting the absence or presence of a tape in the channel, as can be appreciated, that any switching mechanism suitable for detecting the presence or absence of the tape can be employed.

Once the tape is inserted into the channel 70, the controller 29 must now determine which module 111 the merchandise should be stored in and in which column and the location within the column at which the tape should be stored. Accordingly, the controller 29 instructs the motor 60 to turn clockwise (CW) or counter-clockwise (CCW) which drives a pulley 75, which is engaged with a chain 61, to cause the roller 62 to move in a proper direction. This plastic roller 62 passes through an opening in the channel 70 and pushes the tape to the right or to the left according to the instructions for a predetermined distance (approximately two inches in the present example). A bar-code reader 30 is disposed adjacent to the channel 70 with an opening 71 therein such that the bar-code reader 30 attempts to read a bar-code label attached to the side of the tape. If this attempt is unsuccessful, the controller 29 instructs the motor 60 to reverse its rotation such that the roller 62 will push the tape in the opposite direction and the bar-code label attached to the tape will again pass through the opening 71 such that the bar-code reader 30 has another opportunity to read the bar-code. This back and forth movement is repeated until the bar-code 30 has been read and the controller 29 confirms the merchandise ID number of the tape. The bar-code provides both the necessary merchandise identification number and the storage location within the machine to the controller. It should be noted that the position of the roller 62 is conveyed to the controller 29 by signals generated from a photo-interrupter 69 and a corresponding optical disk 68 which is attached to the chain 61. These signals indicate the location of the roller 62 to the controller 29 so that the proper directional signals can be issued to the motor 60.

Upon verification of the bar-code, the roller 62 will then place the returned merchandise on the service platform 19 corresponding to the proper module 111 through a opening 66, as shown in FIG. 7. The motor 60 can be any type of reversible motor, such as an AC, DC, stepper motor, etc.

Figure 9A:
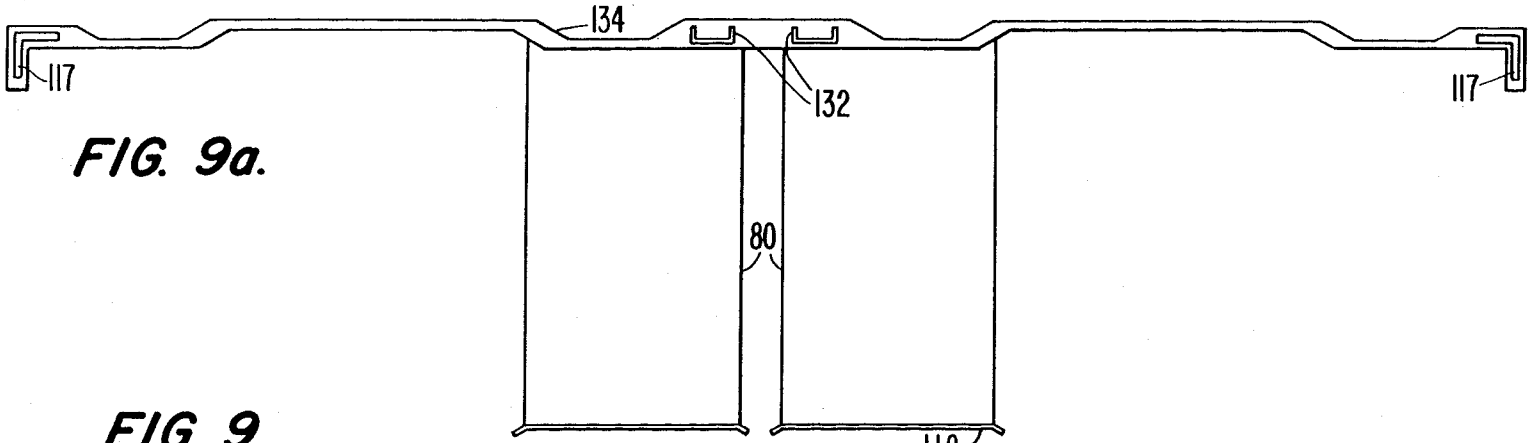
FIGS. 9 and 9*a* show a detailed view of a set of transfer platforms and the elevator for moving the merchandise along the elevator, respectively.
Figure 9:
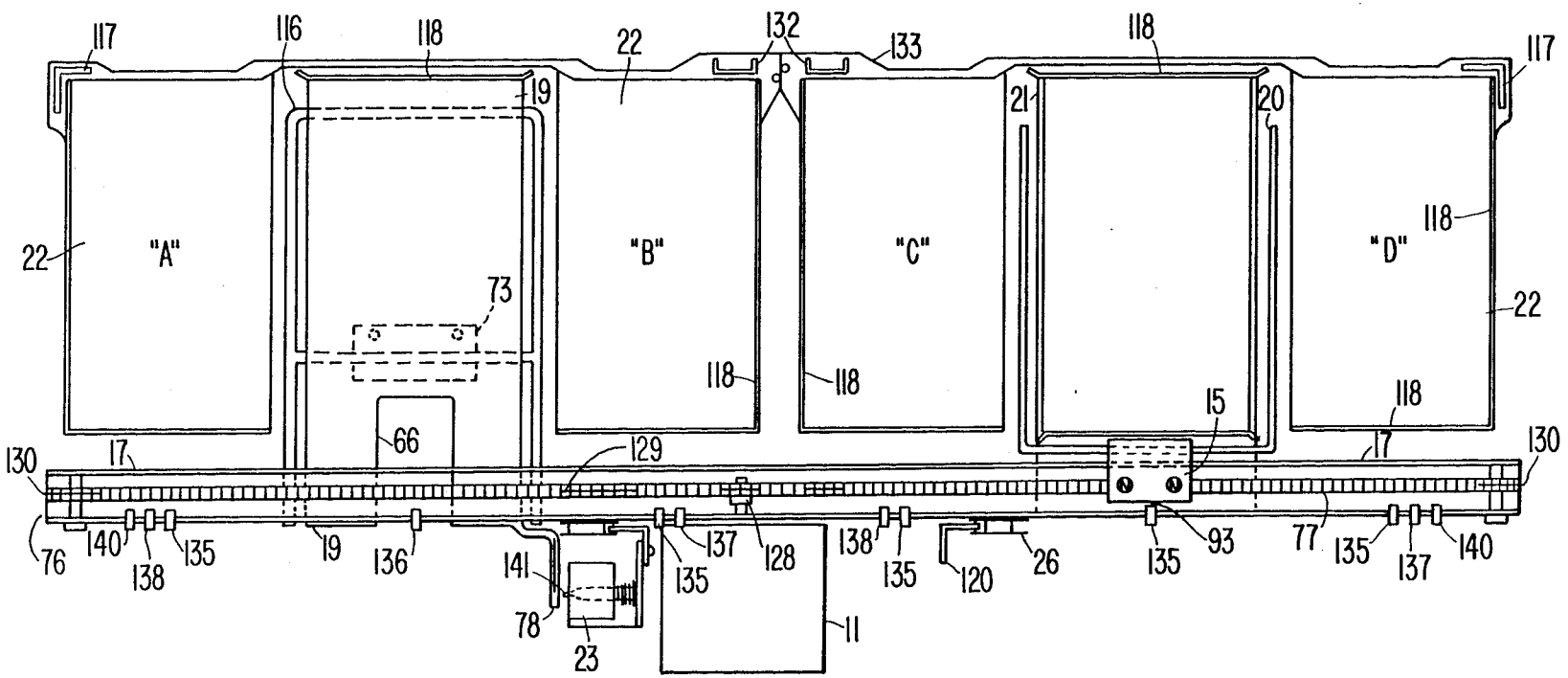

After the roller 62 places the tape on the proper service platform 19 such that it is between the prongs of the transferring fork 20, the tape must be returned to the proper location in the proper column; therefore, the tape must be transferred to the proper service platform 19 or 21. As shown in FIGS. 9 and 9*a*, if the tape is to be returned to either column A or B, it remains on the service platform 19 for vertical movement for the NEUTRAL position. If the tape is to be returned to either columns C or D, the motor 11 rotates the chain 77 such that the transferring fork 20 passes along the two transfer platforms 80 corresponding to columns B and C, respectively, which are shown for sake of clarity in FIG. 9*a*, and the transferring fork 20 stops at a position corresponding to the service platform 21 of the elevator 76 such that the elevator 76 can now be vertically moved to the proper vertical location.

For example, assuming the tape is to be returned to the top of the C column, the elevator 76 travels vertically with the tape on the service platform 21 and the transferring fork 20 surrounding the tape. Once the elevator reaches the top shelf of the machine, the motor 11 causes the transferring fork 20 to move to the left so as to slide the tape onto the shelf in column C. As shown in FIG. 9, the transferring fork 20 is slightly wider than the actual shelves 22 and, therefore, once the tape has been returned to the shelf, the motor 10 is activated to cause the elevator 76 to move vertically downward to return to the NEUTRAL position with the transferring fork 20 remaining in the position where is surrounds the column C. Once the elevator 76 has returned to the NEUTRAL position, the motor 11 is again activated to cause the transferring fork 20 to pass through the gap 200 and to stop at the HOME position which completes the RETURN operation.

Since the merchandise to be placed on the shelves may differ in size (for example, "Beta" tapes vs. "VHS" tapes), the controller 29 of the present invention instructs the transferring fork 20 to travel further than the normal or central position of the shelves so that the tapes rest firmly against the retainer lips 118 of the appropriate shelf. In the present example, for vending video cassette tapes, this over-travel is approximately ½ inch. Thus, upon storage of the tape on the appropriate shelf 22, the controller 29 instructs the transferring fork 20 to return in an opposite direction the ½ inch corresponding to the over-travel, such that the transferring fork 20 is placed in a position which cannot interrupt the vertical movement of the elevator 76.

FIG. 7*a* shows the horizontal moving mechanism of the elevator 76. As set forth above, the horizontal motor 11 causes the chain 77 to move through a pinion gear 128 in a direction based on a signal received from the controller. As can be readily appreciated, the chain 77 can be replaced with any suitable means for this application. The chain 77, in this example, is stretched between spur gears 130 and 129 for shape retention. The motion of the chain 77 also causes spur gear 91 to rotate correspondingly. It is the motion of the spur gear 91 which allows the controller 29 to know the position of the transferring fork 20 which is attached to the chain 77 at slide 15.

In this embodiment, the size of the spur gear 91 has been chosen such that the perimeter thereof or circumference thereof is approximately six inches, which distance is slightly larger than the width of a shelf 22. Accordingly, the three photo-interrupters 92, shown in FIG. 7*a*, will turn on simultaneously only when all three holes 90 of the spur wheel 91 are aligned with the photo-interrupters 92. Since the spur wheel 91 has a circumference slightly larger than the width of the shelf 22, the simultaneous turn on of all of the interrupters 92 will only occur when the transferring fork 20 is positioned such that a shelf 22 is centered between the prongs of the transferring fork 20. In other words, the transferring fork 20 is aligned such that it can move vertically with a column of shelves 22 passing on the inside of the prongs of the transferring fork 20. This alignment position can correspond to any of the columns A, B, C and D or the two positions corresponding to the service platforms 19 and 21, respectively. Thus, in the present example shown in FIG. 9, there are six positions in which the three photo-interrupters 92 will be turned on at the same time and only in these positions will the elevator 76 be permitted by the controller 29 to move in a vertical direction. If the transferring fork 20 is not in any of these alignment positions, it will make contact with one of the shelves 22 and interrupt the vertical movement of the elevator 76. Henceforth, these alignment positions of the transferring fork 20 corresponding to the positions wherein all of the photo-interrupters 92 are activated simultaneously, will be referred to as "vertical access positions" and only when the transferring fork 20 is at one of these six "vertical access positions" will be elevator 76 be permitted to move vertically.

Figure 8:
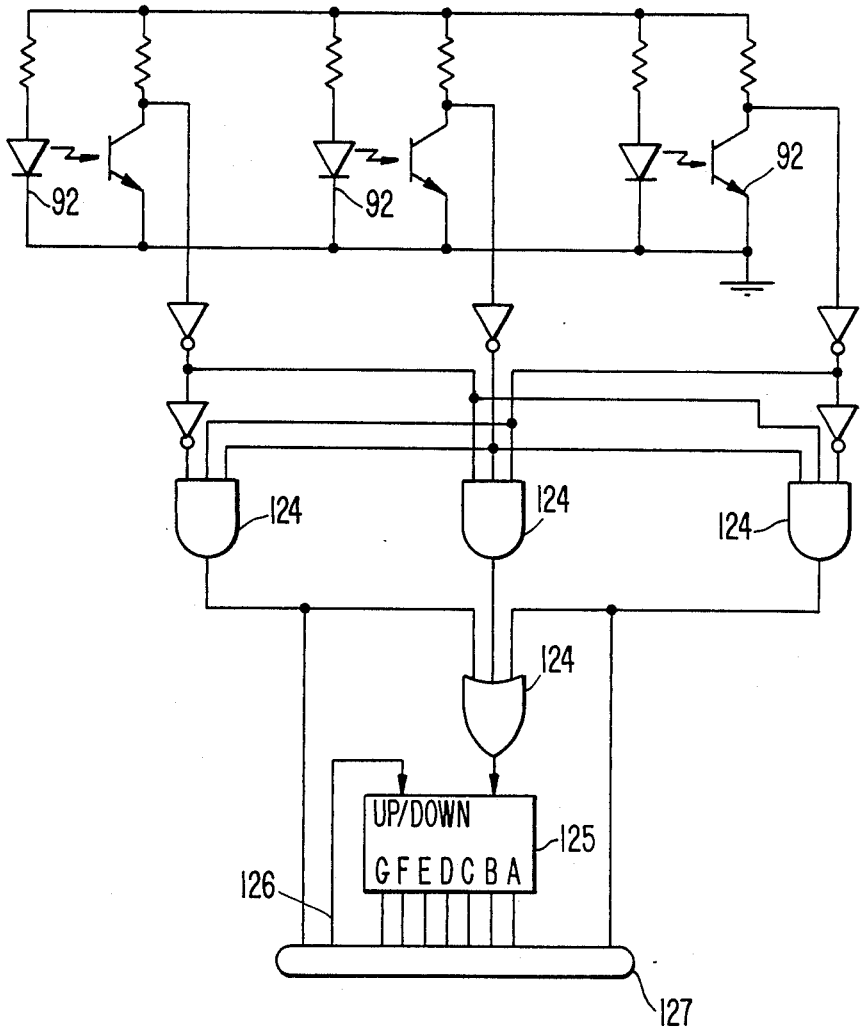
FIG. 8 shows an electrical diagram of the electronic circuitry for providing signals from the decoding mechanism to the system controller.

An electronic schematic for detecting these "vertical access positions" and conveying this information to the controller 29 is shown in FIG. 8. The photo-interrupters 92 corresponding to those at the spur wheel 91, provide an output signal to the gates 124. The signals from the gates 124 trigger an up-down counter 125 to provide a count to an I/O input 127 of the system controller. The motor direction signal 126 determines the direction of the counting and different counts correspond to different "vertical access positions" along the elevator. The holes 90 in the spur wheel 91 are positioned in the present embodiment such that if only two of the photo-interrupters 92 are turned on, this means that transferring fork 20 is approximately ½ inch either right or left from a "vertical access position". The controller 29 then issues a command of "right" or "left" depending on which two photo-interrupters are turned on to relocate the transferring fork 20 after this overtravel.

Figure 10:
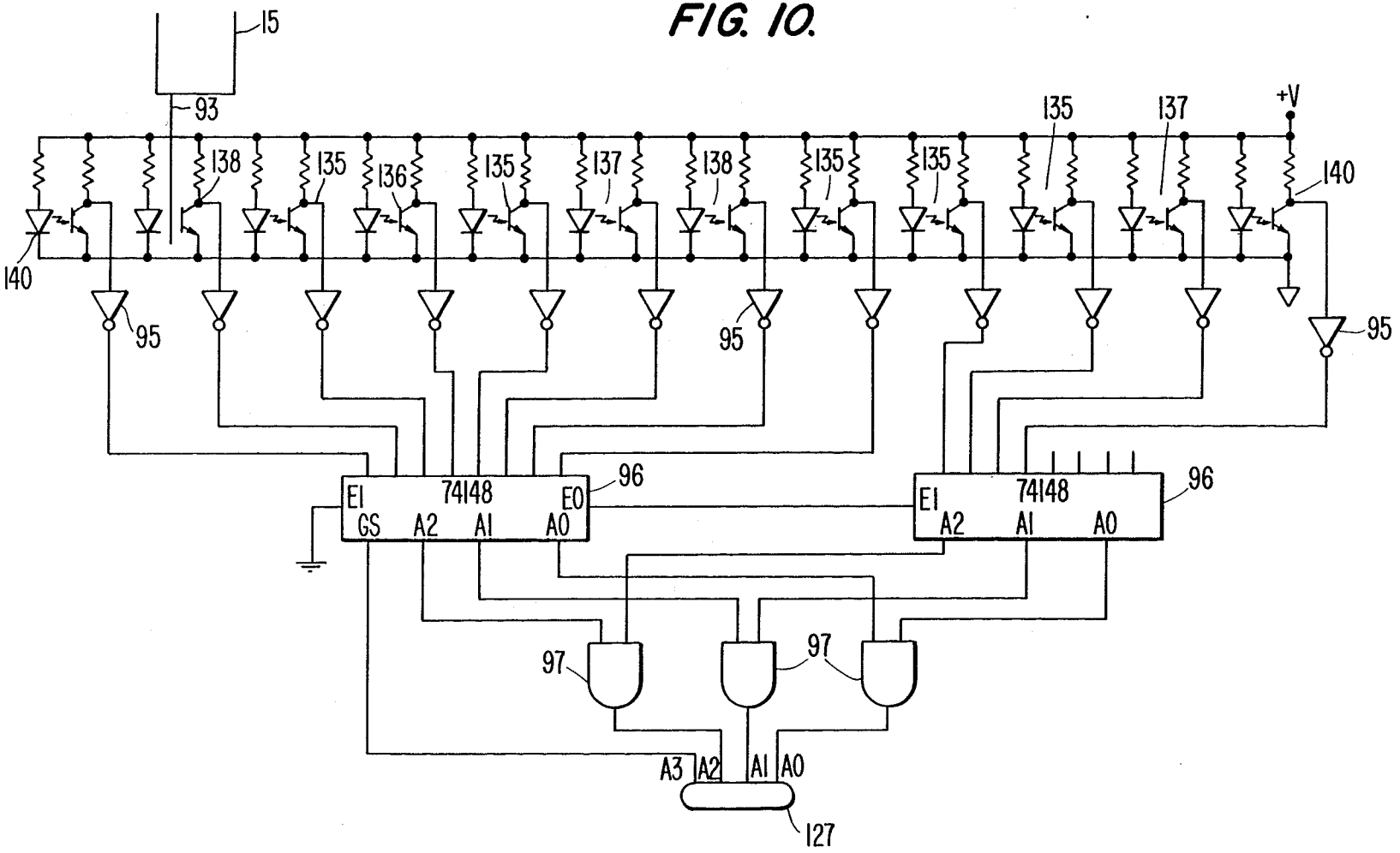
FIG. 10 shows an alternative electronic circuit for providing position encoding of horizontal movement along the elevator to the system controller.

An alternative horizontal position control arrangement is shown in FIG. 10. In this embodiment, twelve photo-interrupters have been placed in positions which designate the respective vertical access positions 135, the HOME position 136, left load and right load positions 138 and the extreme left and right positions 140 of the elevator 76, which are used primarily for diagnostics during the machine operation. An extension 93 from the slide 15 attached to the transferring fork 20, as shown in FIG. 9, will interrupt these photo-interrupters depending on the position thereof which sends a signal through Schmitt-triggers 95 to priority encoders 96. The encoders 96 send signals through the appropriate gates 97 to the controller 29 I/O 127 as a four digit hexadecimal number for providing the positioning signal to the controller. It should be obvious to those of ordinary skill in the art that the position detection circuits for providing the positioning information of the transferring fork 20 to the controller 29 shown in FIGS. 7, 8 and 10 can be replaced with any type of signal sensor, such as plain electrical switches, Hall effect switches, opto-reflectors, magnetic read switches, capacitance proximity switches and any other type of sensor functionally appropriate.

The vertical positioning is done in a similar fashion. As shown in FIG. 11, the pulley 12 causes the idle pulley 101 to move which causes the photo-interrupt disk 102 connected thereto, to interrupt the photo-interrupters 103. This interruption of the photo-interrupters 103 at appropriate intervals, and through a similar circuit to that shown in FIG. 8, allows the vertical position information of the elevators 76 can be conveyed to the controller. It should be obvious to those or ordinary skill in the art that the motor 10 can be any type of motor, such as an AC, DC, servo, stepper, etc.

Accordingly, it should now be clear that in the present vending machine, the system controller 29 need only control vertical and horizontal movements in the same plane and need only control the vertical motor 10 and the horizontal motor 11 to do so. This completely eliminates mechanical and related control circuitry necessary for movement in a third dimension perpendicular to the moving plane, which, therefore, provides a simpler, more economical vending machine.

Figure 14:
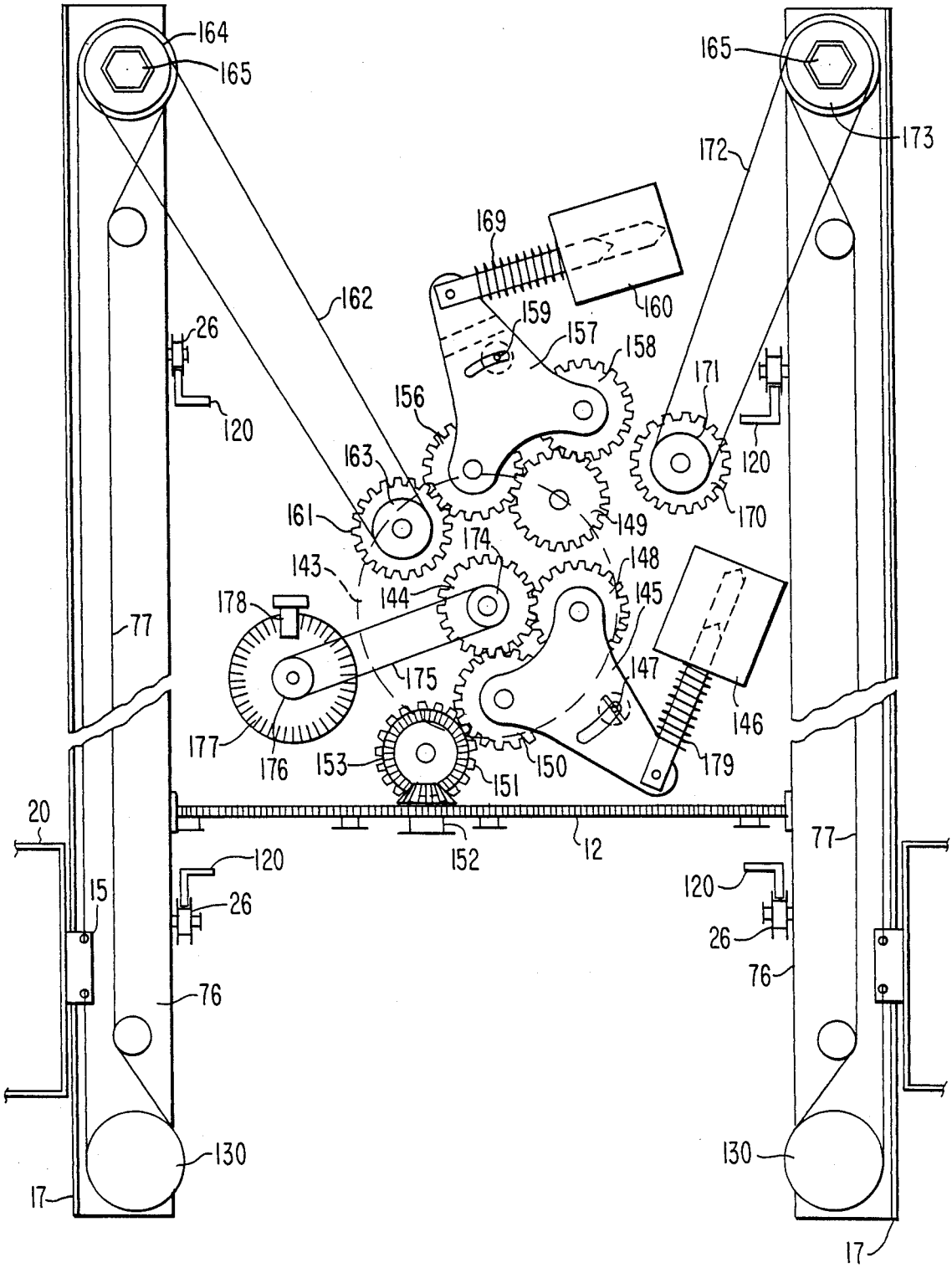
FIG. 14 shows a motor and related gearing mechanisms for providing the vertical and horizontal movement of the elevator using only one motor.

FIG. 14 shows an alternative design of the present vending machine which provides the same two-dimensional column accessing utilizing a single motor 143 for transferring the elevator 76 of both modules in the system and the transferring fork 20 corresponding thereto. The motor 143 transfers movement through pinion gear 144 to a transfer fork mechanism 145 which is activated by solenoid 146. When the solenoid 146 is energized, the transfer fork mechanism 145 slides into a pivot 147 and gear 148 transfers the movement of the pinion gear 144 to the pinion gear 149. When the solenoid 146 is not energized, the gear 150 of the transfer fork 145 engages with the gear 151 transferring movement of pinion gear 144 to gear 151 and maintaining the same direction. The gear 151 is permanently engaged with a conical gear 153 which is engaged by conical gear 152 to transfer the movement of the pinion gear 144 to the conical gear 152 in a 90° movement plane. The conical gear 152 is engaged permanently with the timing belt pulley 154 which drives the timing belt 12 which is attached to the elevators 76 in the same way as the two motor embodiment. Idler pulleys 155 retain belt 12 in the proper position.

Upon energization of solenoid 146, the motion of the substantially T-shaped motion transferring arm 145 rotates through the pivot 147 transferring the motion of pinion gear 144 to gear 149 through gear 148 which transfers this motion through gear 156 to gear 161. Gear 161 is permanently engaged with transfer pulley 163 which transfers its motion to the pulley 164 through timing belt 162. The pulley 164 is permanently attached to a hexagonal or other key shaped rod 165 which extends vertically from the bottom of the machine to the top of the machine and can rotate freely within the bearings 166 and 167 at the base and top thereof, respectively. The elevators 76 slide vertically on guides 120 and rollers 26 in the same fashion as the previous embodiment. The elevator 76 also employs a pulley 168 which has a hexagonal or other similar key shaped bore slightly bigger than and which is adapted to accommodate the rod 165 and therefore can slide freely thereon. However, any rotation of the rods 165 transfers to the pulley 168 which engages a chain or timing belt 77 which constitutes an endless loop with the slide 15 carrying the transferring fork 20. Thus, the motion of the pinion gear 144 transfers directly to the transferring fork 20.

Upon energizing solenoid 160, the motion of the substantially T-shaped motion transferring arm 157 rotates through the pivot 159 transferring the motion of pinion gear 144 to gear 170 through gears 148, 149 and 158. The gear 170 is permanently attached to a timing belt pulley 171 which transfers motion through a timing belt 172 to the pulley 173 which is permanently attached to a hexagonal rod 165 which is fashioned from the bottom of the machine to the top of the machine as previously described.

The pinion gear 144 is also permanently attached to a timing belt pulley 174 which transfers its motion through timing belt 175 to pulley 176, which is permanently attached to an optical disk 177. The disk 177 interrupts the beam of the opto-interrupter 178 so that every movement of the pinion gear 144 can be translated to interruptions which are stored in an up-down counter similar to that shown in the previous embodiment, allowing the counter to control the vertical movement of both elevators 76 through the spring 179 which engages a reversible motor 143 with the belt 12 and wires 98 directly. By energizing the solenoid 146, the controller 29 transfers the motion of the reversible motor 143 to the elevator of the left module and by energizing the solenoid 160 transfers this motion to the elevator of the right module.

Figure 16:
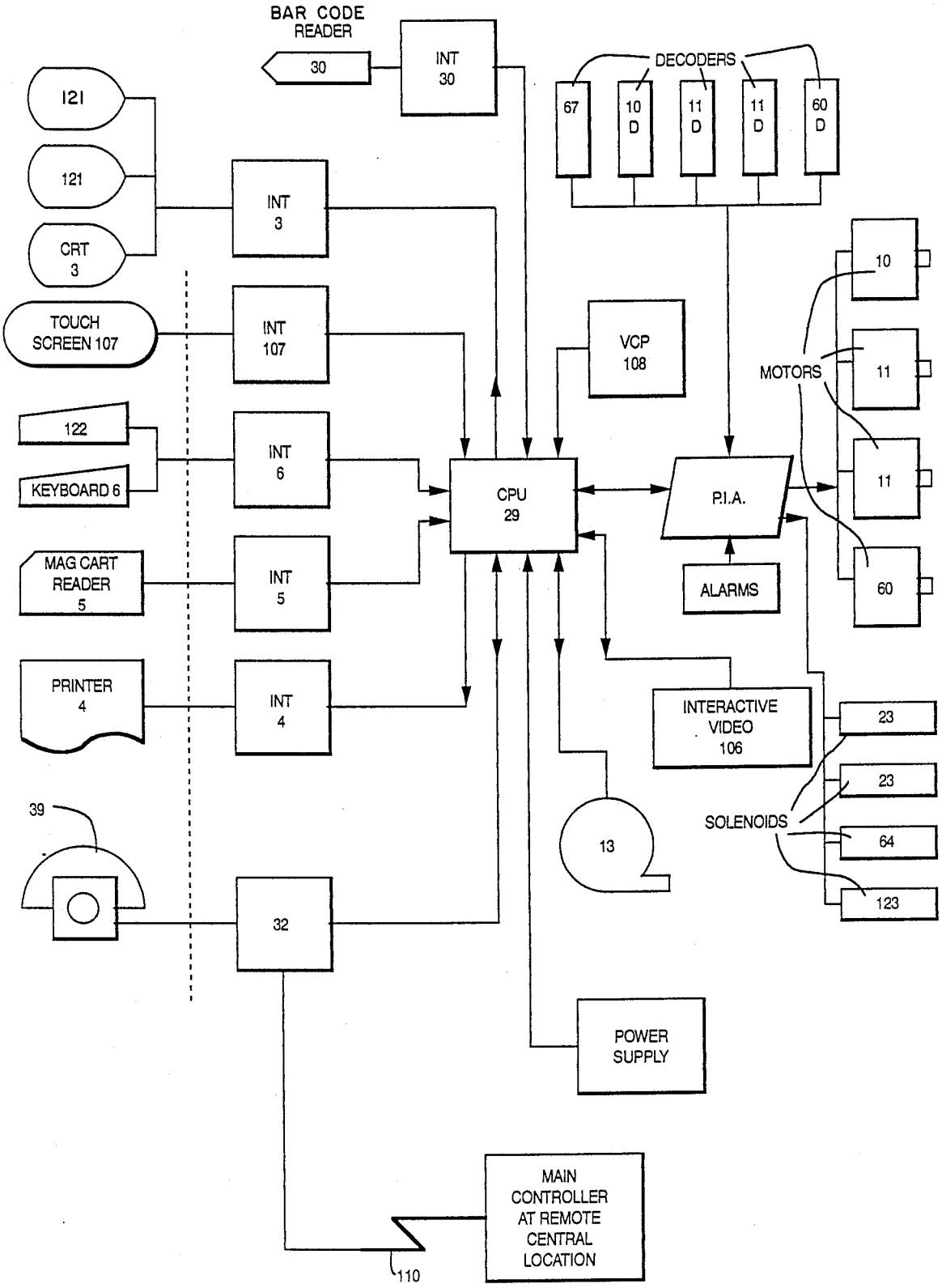
FIG. 16 is a block diagram showing the components of the overall system of the present invention.

FIG. 16 represents a block diagram of the controller system and the interface thereof with the various electronic components of the present invention. The controller 29 comprises any suitable IC processor or personal computer available on the market or specially designed therefore, which can provide the proper system control. Through the appropriate serial or parallel interface control boards, the controller 29 sends instructions to the display 3, receives information from the keyboards 6 and 122, touch screen 107 and magnetic credit card reader 5, and issues receipts to the patrons through an alpha numeric printer 4. In addition, the controller 29 stores all of the received commands, the system programs and transactions at a memory disk 13 (for example a floppy disk). A modem 32 is connected to a telephone handset 39 for patron assistance and is controlled by the controller 29. The vending machine communicates with a main controller 443 which provides instructions and data transfer between the controller 29 and the main controller 443 to control the vending machine from a remote central location. As is readily apparent, a plurality of vending machines can be electrically connected to the main controller 443 for providing communication between all of the vending machines. An example of this will be described below with respect to the RESERVATION procedure.

A PIA 34 provides all the necessary I/O to control the motors 10, 11 and 60, the solenoids 23, 64 and 123, and the decoders 67, 10d, 11d and 60d, and receives position flags and alarms from the motors and alarm sensors. Power supply 310 provides power for the overall system under the control of the controller 29. The control programs of the controller 29 can be stored in ROMs, PROMs, EPROMs or any other suitable memory arrangement. Various update commands can be received through the modem 32 from a remote, central controller 29.

The instructions to the patron can be stored in the memory of the controller 29 or on the disk 13 or alternatively, can be restored and retrieved from the interactive video 106. In addition, instructions and advertising material can be provided by VCP 108.

The additional displays 121 and the corresponding keyboards 122 are also controlled by the controller 29 such that additional patrons can browse through the inventory of the apparatus while a patron is operating the machine.

It should be understood that those of ordinary skill in the art will readily comprehend the operation of each of the individual components set forth above and how these components are functionally interconnected to provide an operative terminal. It is also understood that the various components and the system configuration are shown for illustrative purposes only and that other functionally equivalent components can be used in place thereof as would be known to those of ordinary skill in the art. The interaction of these components in the following operation contexts are for illustrative purposes only and are not intended to limit the system interaction in any way.

Figure 17:
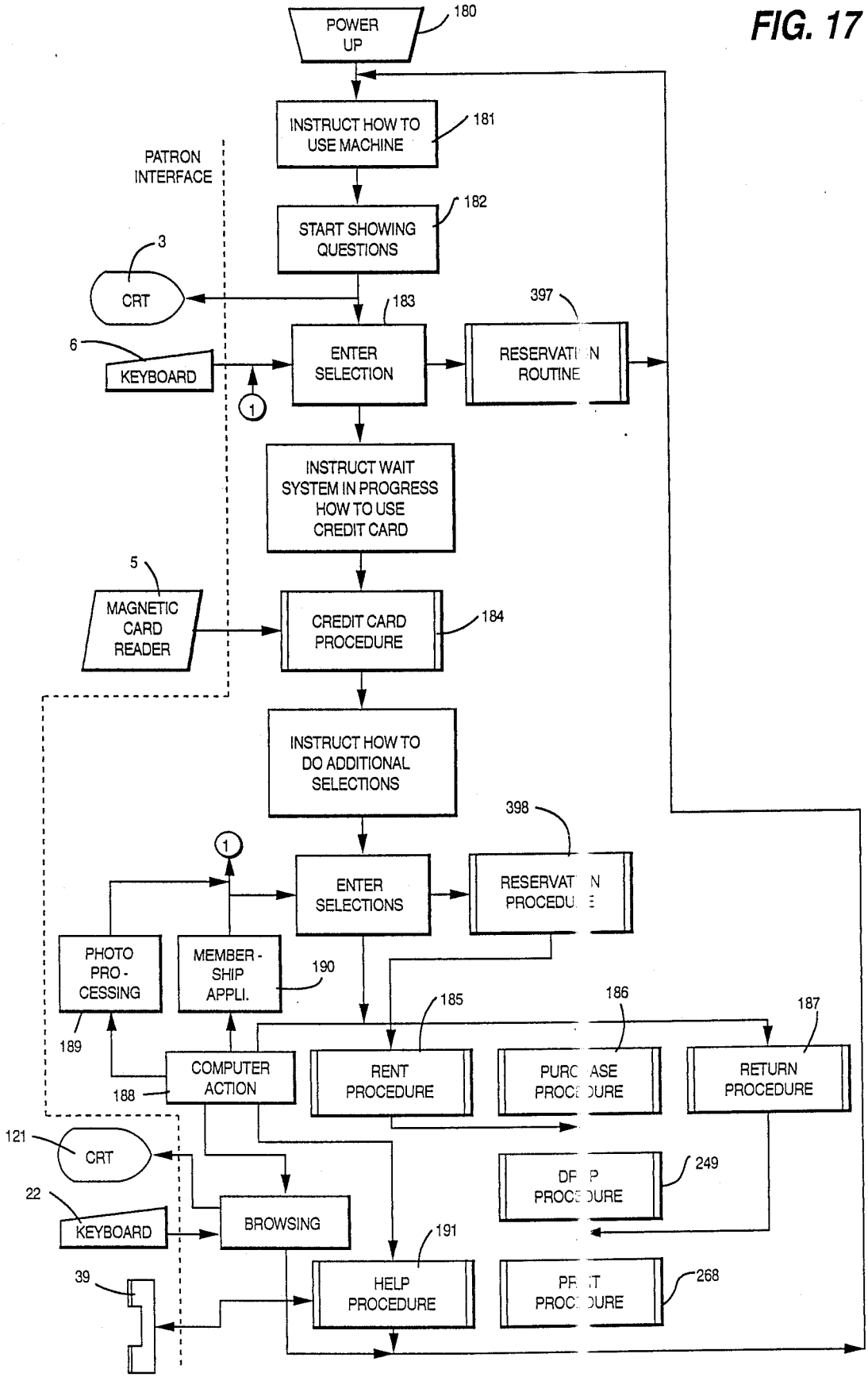
FIG. 17 is a flowchart illustrating the MAIN procedure followed by the present invention.
Figure 23:
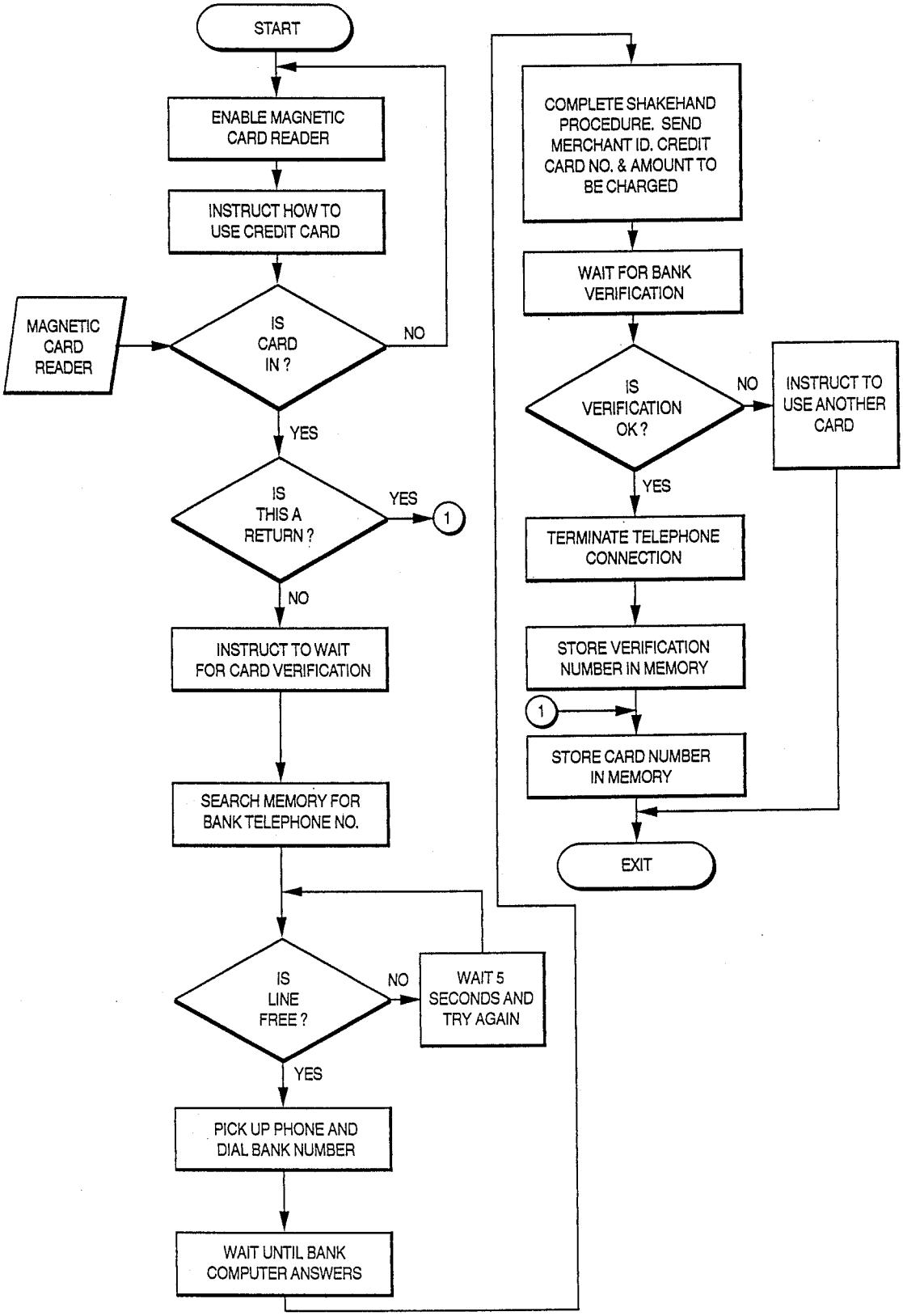
FIG. 23 is a flowchart illustrating the CREDIT CARD procedure of the present invention.

As shown in FIG. 17, when the main flow program comes to particular points in the procedure, for example, at step 184, the procedure branches to sub-routines for performing a particular function, for example, the credit card procedure which is detailed in FIG. 23. Additionally, the main control process includes a PURCHASE procedure 186, a RENT procedure 185, a RETURN procedure 181, a HELP procedure 191, a PRINT procedure 268 and a DROP procedure 249, with the flowcharts corresponding to these controller processing procedures are shown in FIGS. 18–22 and FIG. 24, respectively.

Referring to FIG. 17, upon power-up 180, the program performs some self diagnostics and displays instructions and questions through CRT 3 to patron 181. During the waiting period, if no patron operates the machine, the machine will display advertising segments of movies available for vending through the VCP 108 or can advertise local or national products or services through the interactive video 106. Upon the patrons command 183, through the touch screen 107 or keyboard 6, the machine, through the interactive video 106 or the memory disk 13, will issue instructions to the patron concerning the language of the instructions, the type of services desired, i.e. RENT, RETURN, BUY, etc. The patron states the patron's choice through the keyboard 6 or touch screen 107 and the controller 29 instructs the patron to insert the patron's credit card through the credit card reader 5.

Upon insertion of the credit card, the controller 29 will start executing the CREDIT CARD procedure 184 (FIG. 23) in which it will place a verification call through modem 32 to a local or central bank or remote card identification center.

Figure 19:
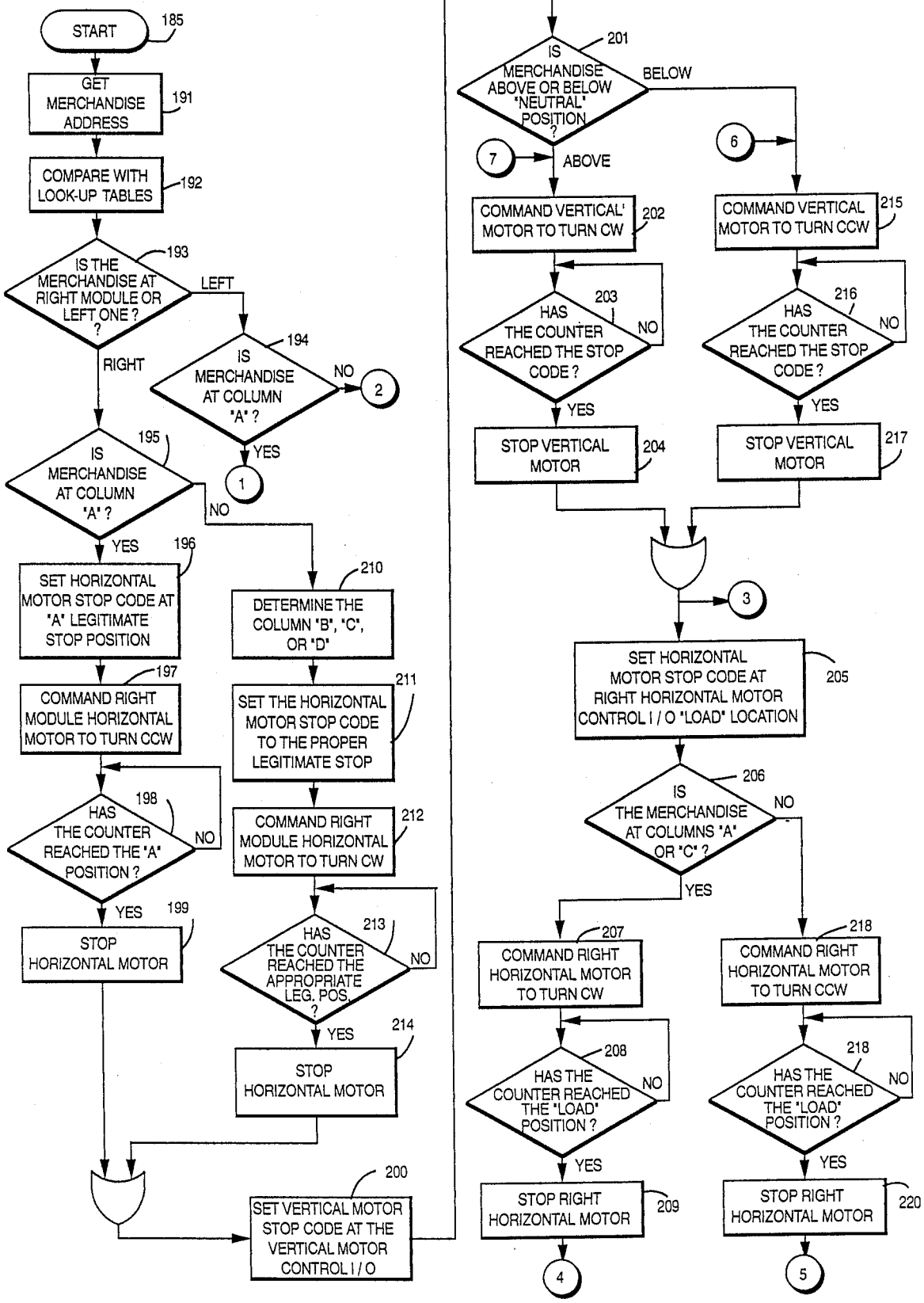
FIGS. 19 and 19*a* are flowcharts illustrating the RENT procedure of the present invention.
Figure 19A:
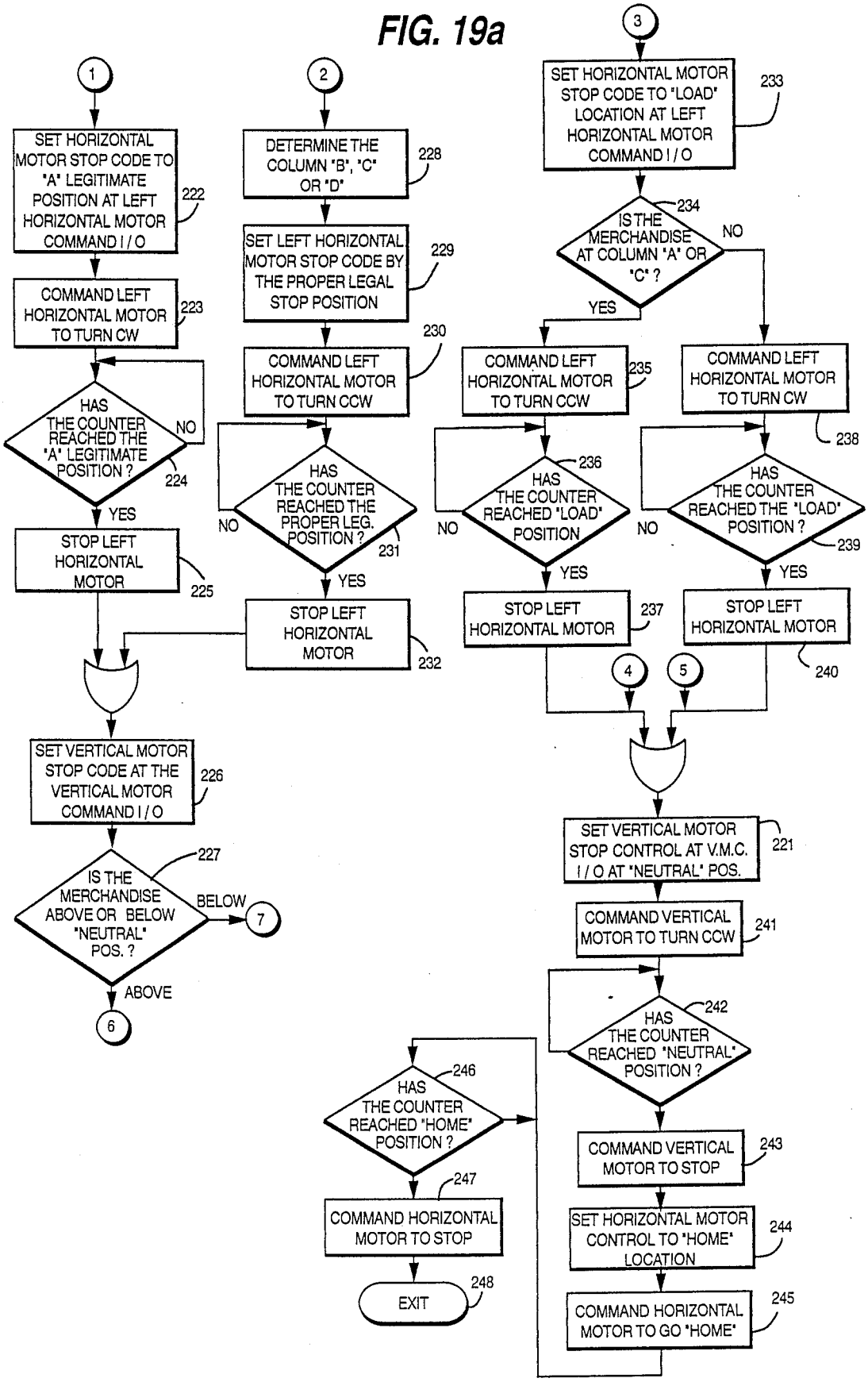
Figure 20:
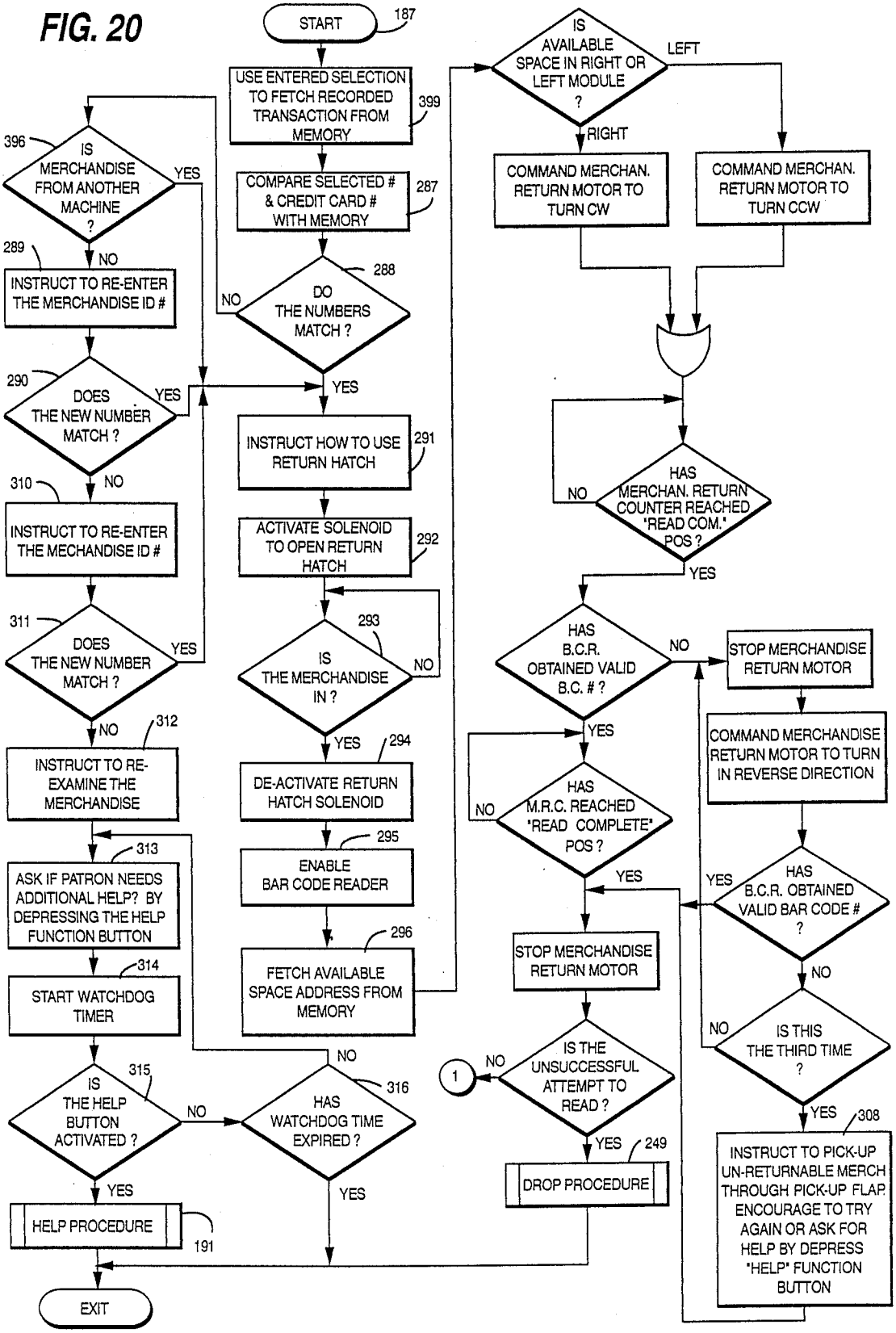
FIGS. 20, 20*a* and 20*b* are flowcharts illustrating the RETURN procedure of the present invention.
Figure 20A:
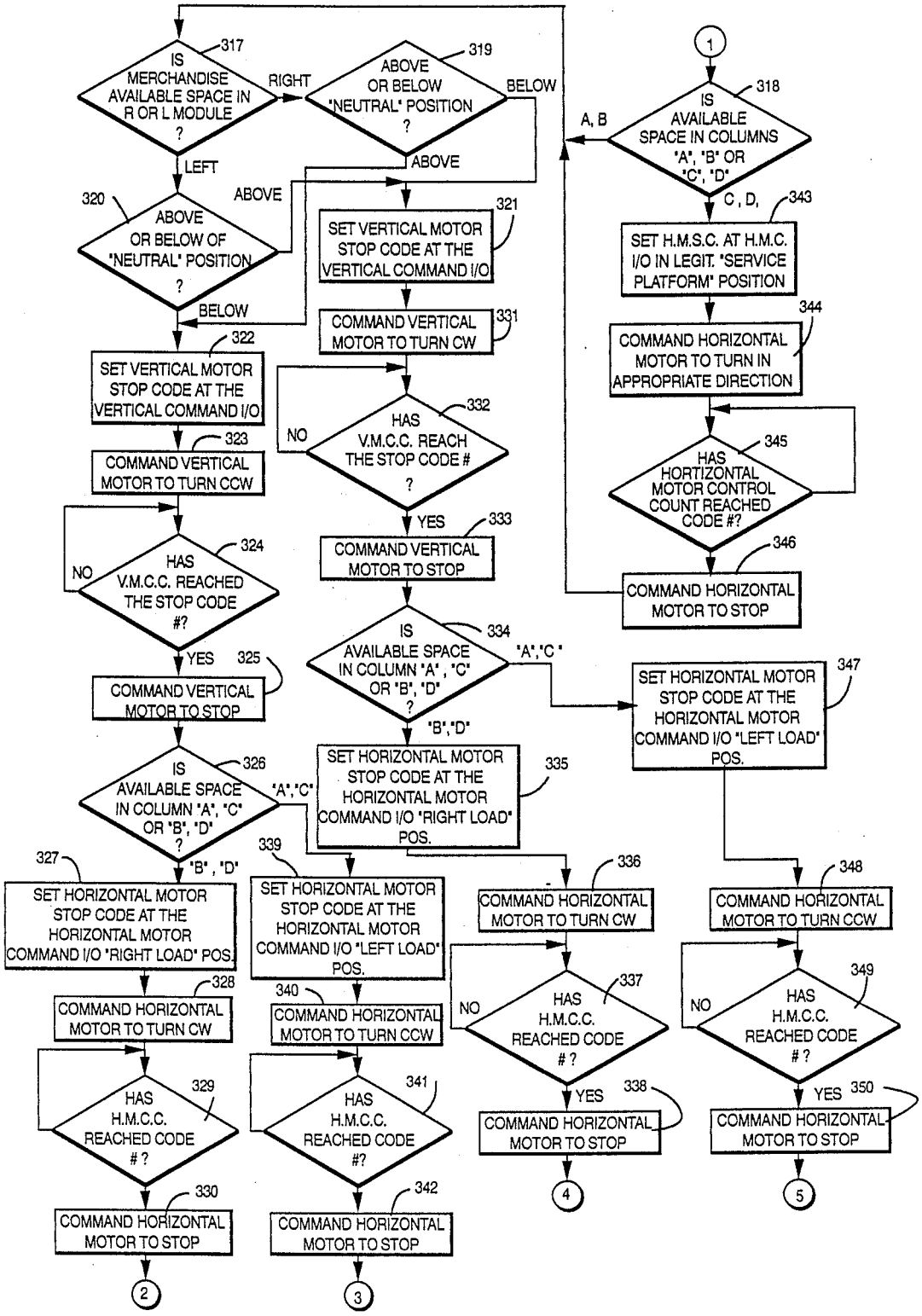
Figure 20B:
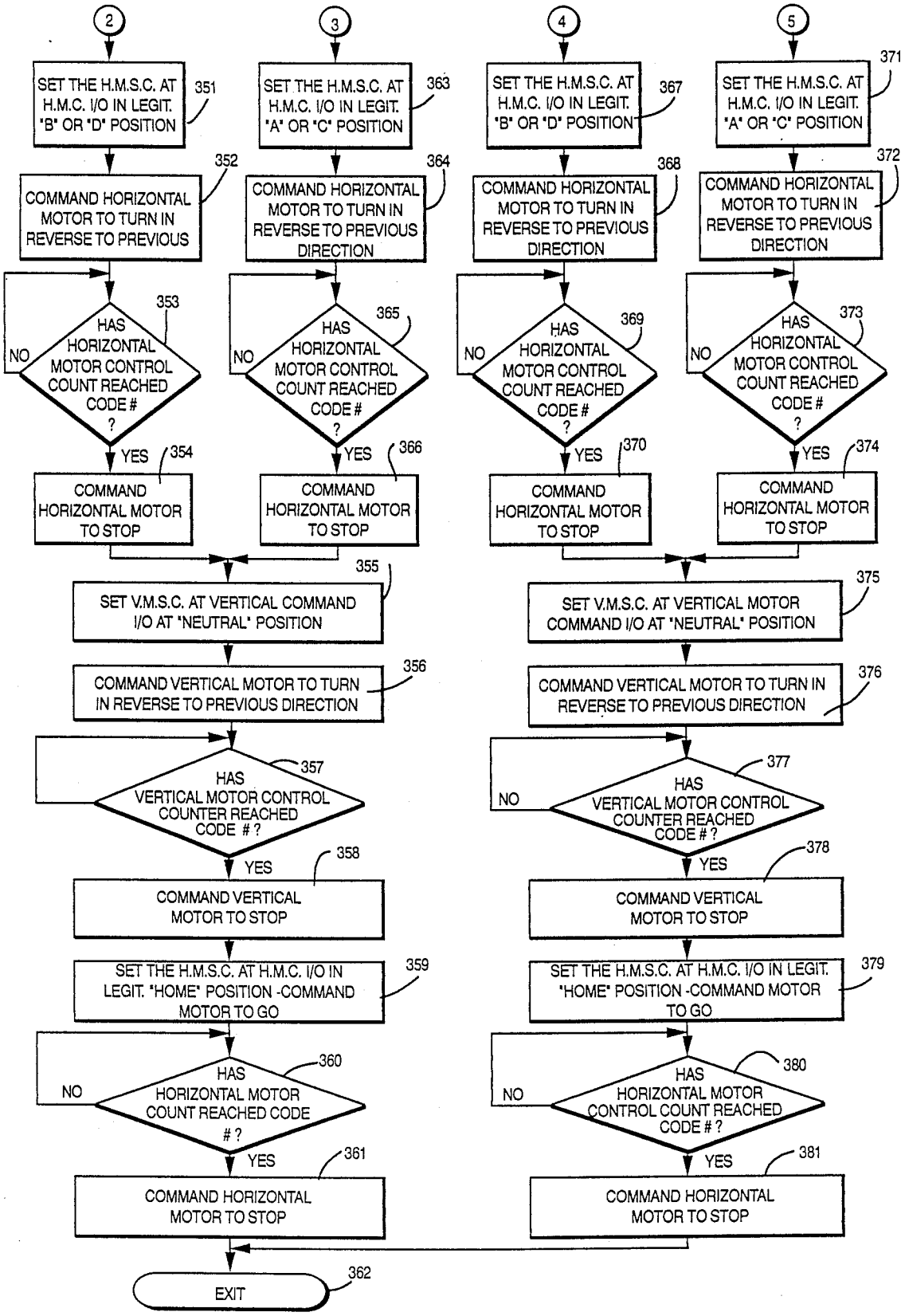
Figure 21:
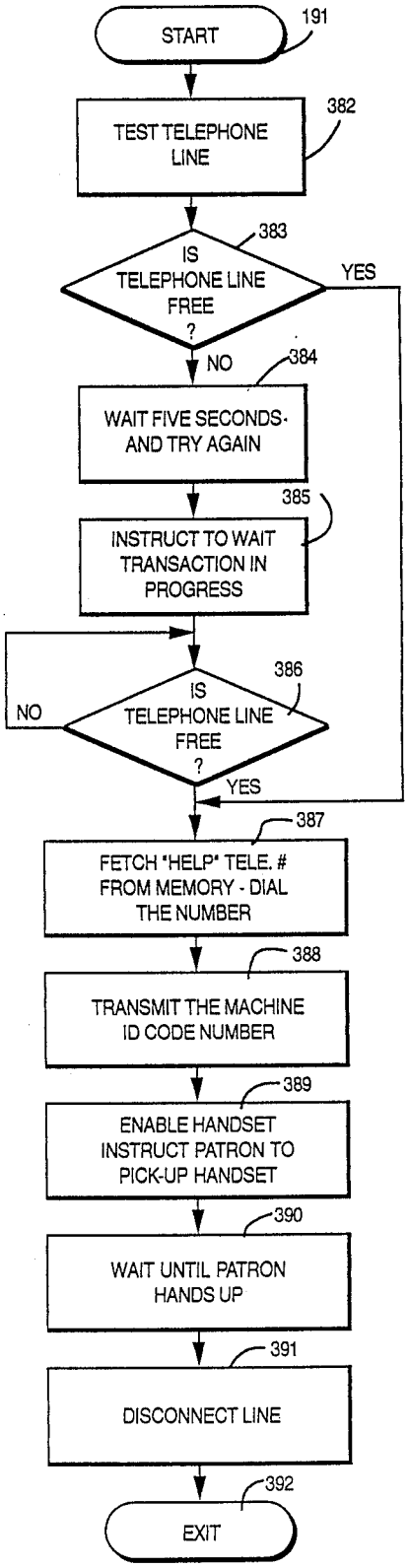
FIG. 21 is a flowchart illustrating the HELP procedure of the present invention.

Upon receiving a credit card validation, the controller 29 issues new instructions to the patron through the existing memory or interactive video 106 and, depending on the choice of the patron, performs either the RENT procedure 185 (FIGS. 19 and 19*a*), the PURCHASE procedure 186 (FIG. 18) or the RETURN procedure 187 (FIGS. 20, 20*a* and 20*b*). If the choice of the patron is for a non-machine function, the controller 29 will follow the routine 188 in which the patron can browse through the inventory of the machine through CRT 121. This routine also allows the patron to apply for membership 190, through keyboard 6, or to deposit film for development, through the process 189. The patron is also given the opportunity to obtain additional information or help, through HELP procedure 191 (FIG. 21).

If the patron wants to rent or buy merchandise and after the patron enters the identification number of the merchandise, the controller 29 will search it's memory data base to find if this particular article is available. If it is not available, it issues a new set of instructions asking the patron to make another choice. Assuming the object chosen is available, the controller 29 will check through the PIA 34 if the elevators 76 are in a vertical access position and then will issue a command to the motor 10 or 11 to go to a position which the memory designates for this particular item using the procedure 185 (FIG. 19).

In this procedure, the controller 29 provides an address 191 of the location of the merchandise and compares it with the look-up tables 192 which specifies the right or left module, the column A, B, C or D and the vertical location of the merchandise above or below the NEUTRAL position. Through the comparison 193, and assuming the merchandise is located in the right module, a decision 195 is made to determine if the merchandise is located in column A. Assuming the merchandise is located in column A, the controller 29 sets a code (a hexadecimal number) at the horizontal motor stop control I/O 196 which the counter 125 (see FIG. 8) will eventually reach upon the presence of the transferring fork 20 in the vertical access position corresponding to column A. A command to the right horizontal motor to start turning CCW 197 starts the motor 11 which continues to move until it reaches a pre-set code 198 at which time a stop command 199 is issued to motor 11. If the merchandise is located in columns B, C, or D 210, the controller 29 sets the horizontal motor stop code to the proper position B, C or D 211 and commands motor 11, of the right module, to turn CW 212. As motor 11 moves the transferring fork 20 into the proper position, the counter 125 reaches the pre-set number 213 and stops 214 the motor 11. At this time, the transferring fork 20 is located in both the NEUTRAL position and the proper "vertical access position".

The controller 29 then sets the vertical motor stop code at the vertical motor control I/O 143 and, upon verification of the position of the merchandise with respect to the NEUTRAL position 201, issues a CW 202 or CCW 215 turn direction to vertical motor 10. As soon as the counter reaches the code 203 or 216, the controller 29 stops the vertical motor 10, 204 or 217. At this time, the transferring fork 20 surrounds the desired merchandise in the desired column and is ready to transfer it.

The controller 29 sets a horizontal stop code 205 to load the merchandise to the service platform 19 or 21, depending on the column location of the merchandise 206. If the merchandise is located in column A or C, the command to motor 11 is to turn CW 207; if the merchandise is located in columns B or D, the command is to turn motor 11 CCW 218. As soon as the counter reaches the load position 208 or 219, the controller 29 issues a command to stop the horizontal motor 209 or 220. At this time, the merchandise stands loaded on the service platform 19 or 21 and is surrounded by the transferring fork 20. The controller 29 then sets the vertical motor stop code 221 to the NEUTRAL position and commands the motor 10 to turn in the appropriate direction 241. When the counter reaches the NEUTRAL position 242, the controller 29 commands the vertical motor 10 to stop 243. A stop command instruction for the horizontal motor is set at the proper I/O 244 to send the transferring fork to the HOME position and a command to motor 11 is issued to turn in the appropriate direction to reach the HOME location 245. When the counter reaches the HOME location 246, the controller 29 issues a stop command 247. The merchandise is now on the service platform 19, at the HOME position and the computer program exits from this BUY or RENT procedure 248.

It should be obvious that, if decision box 193 determines that the merchandise is located at the left module, this procedure will follow the steps 194 and steps 222, 223, 224, 225 if the merchandise is located in the A column or steps 228, 229, 230, 231, 232 if the merchandise is located in columns B, C or D. Further, the steps 226 and 227 determine if the merchandise is in the left module, above or below the NEUTRAL position (FIG. 19*a*). The steps 233, 234, 235, 236, 237, or 238, 239, 240 pertain to the same functions as described earlier, but for the left module.

Figure 24:
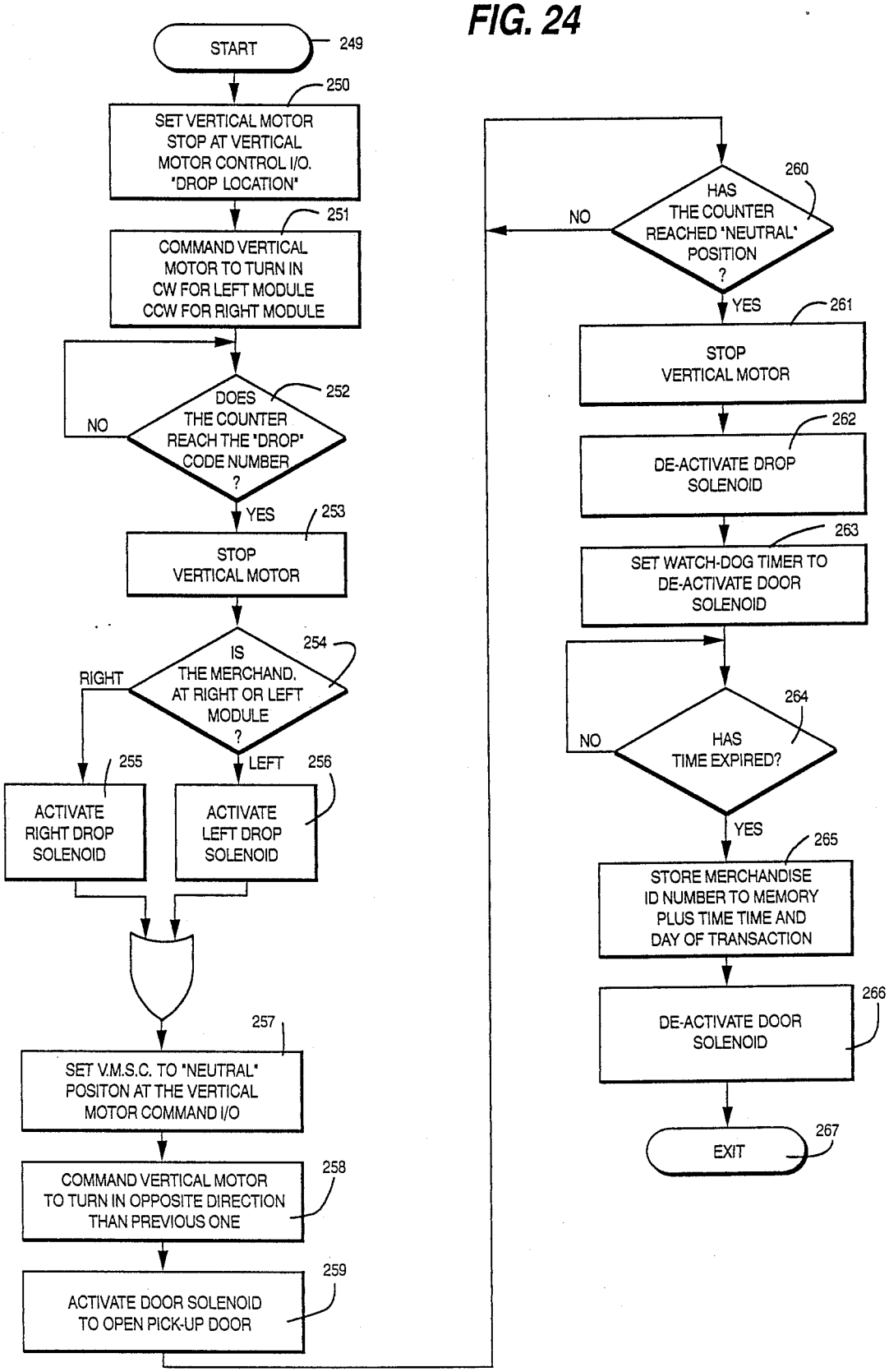
FIG. 24 is a flowchart illustrating the DROP or DISPENSE procedure of the present invention.

Now that the merchandise is located on the service platform 19 in the HOME position, the main procedure continues with the DROP procedure 249 (FIG. 24). The controller 29 commands the vertical motor to stop at the DROP location which is any location below the NEUTRAL position after the extension 78 of service platform 19 has gone below the solenoid 23. Accordingly, the controller 29 commands the vertical motor to turn CW if the merchandise is located in the left module or CCW if the merchandise is located in the right module to cause the appropriate elevator to begin to descend 251. As soon as the counter reaches the DROP position 252, a stop command to the vertical motor 10 is issued 253. According to the module being activated 254, the controller 29 then activates the right DROP solenoid 255 or the left DROP solenoid 256.

At this time, the merchandise is located below the solenoid 23 and the extended solenoid armature 141 will engage with extension 78 of service platform 19 as the elevator beings to rise. The controller 29 sets a stop code to the vertical motor I/O for the NEUTRAL position and commands vertical motor 10 to turn in the direction opposite to the previous direction 258. During this movement, the activated solenoid 23 engages through its armature 141 with extension 78 of the service platform 19 and, because the movement is upward, forces the service platform 19 to pivot on its hinges 79 and tilt to the extent that the merchandise drops down the chute 81 through the pick-up slot 14 so that the patron can pick up the merchandise through flap 109.

The controller 29 activates the solenoid for the pick-up door 259 and the counter counts until the elevator 76 reaches the NEUTRAL position 260. The controller 29 then issues a stop command to the vertical motor 261, de-activates the DROP solenoid 262, and sets a timer 263 to allow the patron to pick up the patron's merchandise through flap 109. The controller 29 also stores the merchandise ID number 265 into the main memory along with the time and day of the transaction. As soon as the watchdog timer expires 266, the controller 29 de-activates the door solenoid 266 and exits from this procedure 267.

Upon exiting the DROP procedure, the controller 29 enters the PRINTING procedure 268. During this procedure, the controller 29 obtains a price from memory 269 and, if the transaction is a RENTAL 270, the controller 29 obtains the time of day from a real time clock 271. If this transaction is a return, the controller 29 calculates the time rented and multiplies this by the price per day 273. If the transaction is a multiple one 274, the controller 29 provides the printer will all the necessary information since the last transaction 275 and commands the printer to print a receipt 276. Further, the controller 29 stores the entire transaction in the non-volative memory 277 and instructs the paper cutter to cut the receipt 278. Finally, the controller 29 thanks the patron and instructs the patron to pick up the patron's receipt 279 and 280 and the procedure flow is returned to its original standby state to await another transaction.

Figure 18:
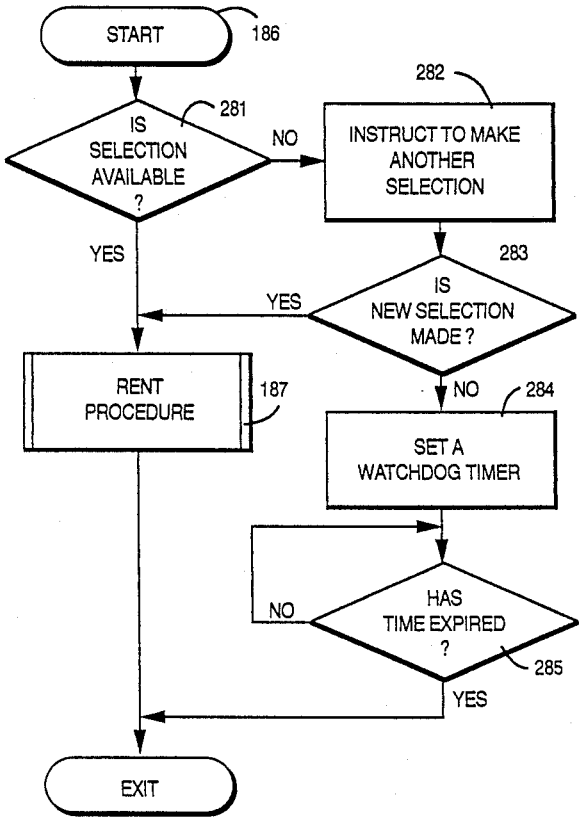
FIG. 18 is a flowchart showing the PURCHASE procedure of the present invention.
Figure 22:
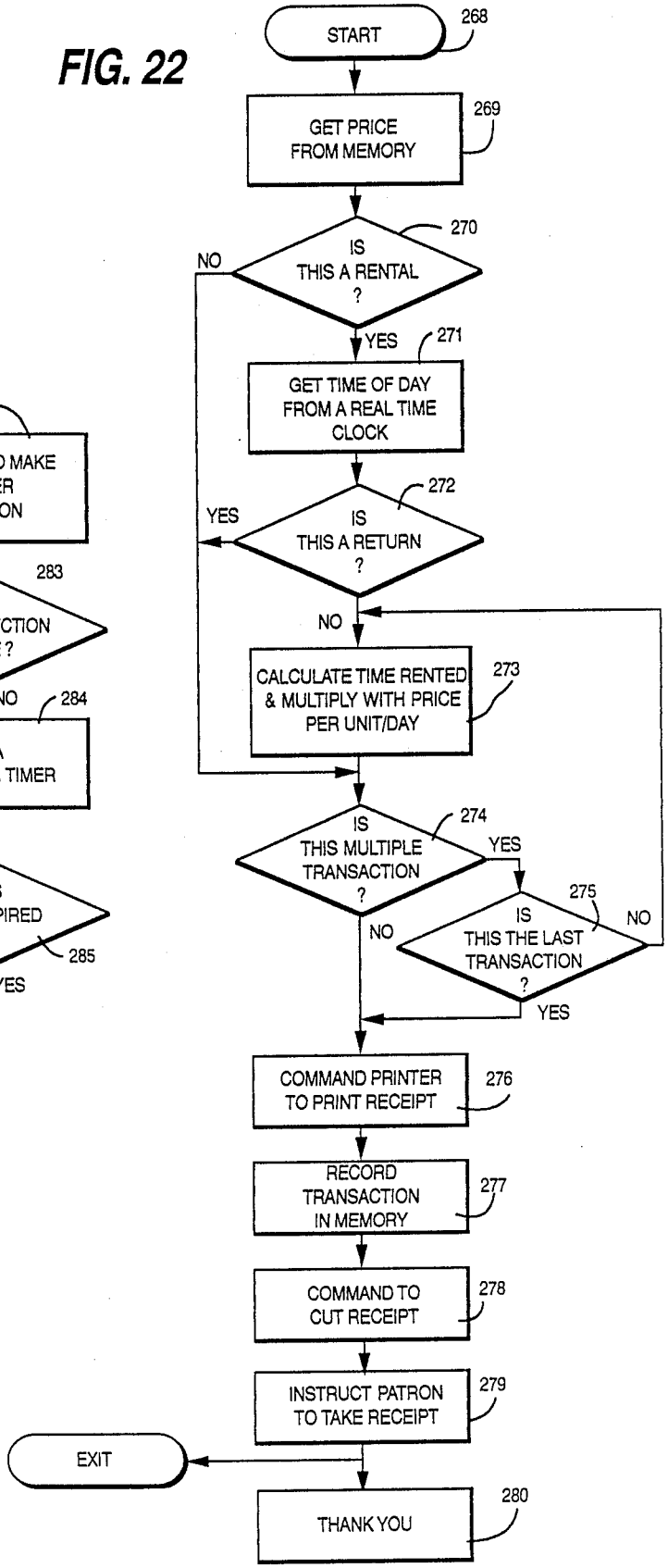
FIG. 22 is a flowchart illustrating the PRINTING procedure of the present invention.

In the case of a purchase, the controller 29 enters into the PURCHASE procedure 186 (FIG. 18). During this procedure, if a selection is available 281, the controller 29 jumps to the RENT procedure 187. If the selection is not available, the controller 29 instructs the patron 282 to make another selection and, if the new selection 283 is not made, the controller 29 sets a timer 283 and waits for the new selection 285. If the selection is made before the time is expired, the controller 29 jumps to the RENT procedure 187 for dispensing the merchandise. If the time has expired, the controller 29 exits the procedure.

If the transaction to be performed is a RETURN of merchandise, the controller 29 enters into the program designated RETURN procedure 187 in which the controller 29 uses the ENTER selection to fetch recorded transactions from memory 399 and compares the selected number and the credit card number with the information from the memory 287. The comparison 288 produces a match or mismatch of the ID numbers. In case of mismatch 289, the controller 29 identifies if the merchandise is from another machine 396. If the merchandise is from another machine, the controller 29 instructs the patron on how to return the merchandise 291. If the merchandise is not from another machine, the controller 29 instructs the patron to re-enter the merchandise ID number. If the new number does not match 290, the controller 29 instructs the patron to re-enter the merchandise ID number 310. If the new number again does not match 311, the controller 29 asks the patron to examine the merchandise to see what is causing the problem, such as the printed label is missing, the merchandise is from a different machine, etc. The controller 29 also asks the patron 313 if additional help is needed and encourages the patron to use the HELP function button. At this time, a watchdog timer 314 is set so that, if the HELP button is not depressed, the controller 29 exits to its regular standby state. If the patron depresses the HELP button, the controller 29 enters into the HELP procedure, as described in FIG. 21.

If nothing is wrong with the merchandise and the controller 29 matches the ID numbers 288, the controller 29 instructs the patron to use the return hatch 291. The controller 29 also activates the solenoid 64 to open the return hatch 292. If the controller 29 detects, through the photocell 67 and mirror 73, that the merchandise is in the return channel 70, 293, it de-activates the return hatch solenoid 64, 294 and enables the bar-code reader 295. The controller 29 then fetches from memory, the address of the closes available space 296 and, if the space is in the left module 297, commands the machine return motor 60 to turn CCW 309, and if the available space is in the right module, commands the motor 60 to turn CW 298. When the return counter reaches the read complete position 299, which in this particular example is approximately two inches to the right or to the left from the position that the patron places the merchandise in channel 70, the controller 29 checks if the bar-code reader has obtained a valid bar-code number 300. If for any reason the number is not correct 304, the controller 29 issues a stop command to the motor 60 and a new command 305 to reverse the direction to push the merchandise in the opposite direction allowing the bar-code reader 30 to have another attempt at reading. If the new attempt 306 is still unsuccessful, the controller 29 repeats the above sequence two more times 307 and, if it still cannot read the bar-code, issues an instruction 308 to the patron to pick up the unreadable merchandise through the pick-up flap 109 and encourages the patron to try again or, if the patron needs additional help, to depress the HELP function button. Accordingly, the controller 29 also issues a command to motor 60 to stop 302 and proceed with the DROP procedure 249 before exiting to its standby position.

If the bar-code reader obtains a valid bar-code number 300, when the motor 60 reaches its read complete position 301, the controller 29 issues a stop command to the motor 302 and double checks the reading 303. The controller 29 then determines if the available space is columns A, B or C, D 318. If the available space is in column C or D, the controller 29 places a stop code number in the horizontal motor control I/O 343 in a position corresponding to the service platform 21 and commands the horizontal motor 344 to turn in the appropriate direction. The transferring fork 20 moves the merchandise, which is setting on the service platform 19, horizontally over the transfer platforms 80 and place it in the service platform 21. When the motor control counter 345 reaches the count corresponding to the service platform position, the controller 29 issues a stop command 346 to the horizontal motor.

The controller 29 determines if the available space is above or below the NEUTRAL position 319 and if the available space is in the right or left module 317. If the available space is determined to be in the left module above the NEUTRAL position or the right module below the NEUTRAL position, the controller 29 sets a vertical motor stop code 321 and commands the vertical motor 10 to turn CW 331. If the merchandise is determined to be in the right module above NEUTRAL or the left module below NEUTRAL, the controller 29 sets a vertical motor stop code 322 and commands the motor 10 to turn CCW 323. The difference in direction of vertical motor 10 is due to both elevators 76 being connected through the belt 12 and wires 98 in a fashion such that they counter-balance each other.

When the vertical counter reaches the stop code number 324, the controller 29 issues a stop command to vertical motor 325 and determines if the available space is in columns A, C or B, D 326. If the merchandise is located in columns A or C in the left module, the controller 29 sets the motor stop code for the horizontal motor in a left load position and commands the horizontal motor to turn CCW. If the available space is in columns B or D, the controller 29 sets a stop code at the right load position 327 and commands the horizontal motor 11 to turn CW 328. As soon as the counter reaches the stop code number 329 or 341, depending on the column, the controller 29 issues a horizontal motor stop command 330 or 342. Right load and left load positions are considered non-legitimate vertical traveling positions and, in this example, represent approximately ½ inch over-travel of the transferring fork 20 in the right or left direction. This over-travel is provided to force the merchandise to sit on shelf 22 and rest against the merchandise retaining ledge 118. It should be obvious that if the available space is in the right module, the controller 29 will follow the steps 321, 331, 332, 333, 334 and, depending on the available column space, the steps will continue as steps 335, 336, 337, 338. For the A and C columns, the steps will continue as 347, 348, 349, 350.

At this time, the merchandise is resting in the position allocated by the return position and the program is ready to return to its normal standby position (FIG. 20*b*). Depending on the module and column in which the merchandise is at rest, the controller 29 sets the horizontal motor stop control to a vertical access position 351, 363, 367, 371 and commands the horizontal motor to turn in a direction opposite to the previous direction 352, 364, 368, 372 and 365, 369, 373, the controller 29 issues a horizontal motor, stop command 354, 366, 347. This merchandise now rests in the allocated space and the transferring fork 20 is in a "vertical access position". This means that the transferring fork 20 can travel vertically without interfering with the merchandise.

The controller 29 now sets the vertical motor stop command to the NEUTRAL position 355 or 375, depending on the module, and commands the vertical motor to turn in the direction opposite to the previous direction 356, 376. As soon as the vertical motor control counter reaches the code 357, 377, the controller 29 issues a stop command 358, 378. At this time, the empty elevator is at the NEUTRAL position and this controller 29 sets a horizontal motor stop control code number to the HOME position 359, 379 to move the transferring fork 20 to the HOME position. When the motor control counter reaches the code number 360, 380, the controller 29 issues a stop command to the horizontal motor 361, 381. At this time, the elevators 76 are in the NEUTRAL position and the transferring fork 20 is in the HOME position. The controller 29 then exits to the next procedure 362 which may be the PRINTING procedure 268 (FIG. 22) described above.

Referring to FIG. 21 which describes the HELP procedure 191, if for any reason or difficulty, a patron needs additional help and depresses the HELP button on keyboard 6, the controller 29 tests the telephone line 382 and, if for any reason the line is not free 383, waits for a certain length of time 384 (for this particular example, five seconds) and also instructs the patron to wait 385. As soon as the line becomes free 386, the controller 29 fetches the help telephone number from memory and dials the number. The help telephone number is located at the central communication post and, upon receipt of the telephone call, identifies the particular machine by a transmitted code number 388. When an operator answers the telephone, the controller 29 instructs the patron 389 to pick up the telephone handset 39 and state the patron's question to the operator and waits until the patron hangs up 390 to disconnect the line 391. The controller 29 then exits this program 392 to the standby status.

A flowchart relating to the procedure for depositing film into the apparatus is not shown because the steps are very few. In the event that the patron requires to deposit film for development, the controller instructs the patron to put the patron's credit card through the reader 5 and then releases the mechanism of the film receptacle 112. The controller 29 then instructs the patron to place the film to be developed in an appropriate envelope and into the receptacle 112. The patron is also instructed to keep a portion of that envelope as a receipt for return of the developed film. The film is dropped into the appropriate basket 119 and the controller 29 issues an acceptance receipt through printer 4 stating the time and day when the film was deposited and the time and day for pick up. The whole transaction is recorded into the non-violate memory 13 and the transaction is considered finished. Obviously, an arrangement must be made with a film processing studio to pick up the film to be processed on a daily basis through door 113 and upon completion of developing, place the developed film and negatives in appropriate boxes resembling the size and shape of the vended merchandise containers, and return it to the vending machine through its regular return port by using a controller 29 authorized code for this purpose. Also, a coded container can be dispensed to the patron such that undeveloped photographic material can be placed therein. Upon insertion of the undeveloped material, the coded container can be returned to the vending machine where it can be stored at a location in the vending machine corresponding to the code. The coded container including the photographic material can be dispensed to a photographic material developer so that the photographic material can be developed. The coded container including the developed photographic material can then be returned to the vending machine where it is stored at a location corresponding to the code. The machine will store developed film in appropriate shelves and will return it to the patron who activates the machine by pressing the appropriate function button on keyboard 6. By following the instructions of the controller 29, the patron can pick up the film by passing a credit card through card reader 5 and entering the receipt number on keyboard 6. The controller 29, upon comparison of this data with the existing stored data during the deposit transaction, will locate the appropriate box and, using the previously explained RENT procedure dispenses the film to the patron, calculates the charges and issues a charge receipt through the printer 4.

Figure 26:
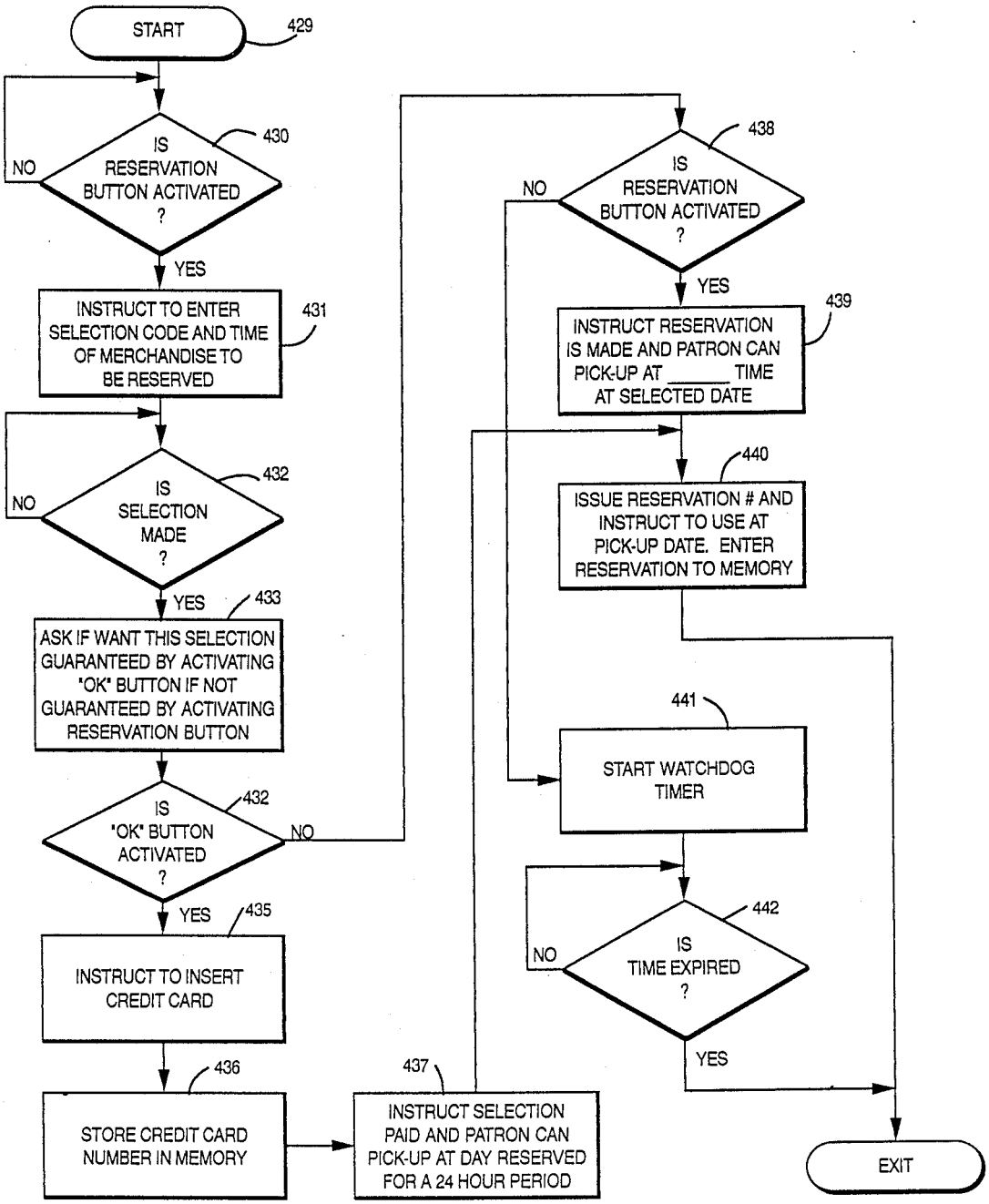
FIG. 26 is a flowchart illustrating the RESERVATION routine of the present invention.

FIG. 26 is a flowchart for a RESERVATION routine which allows the patron to reserve a tape at a number of vending machines in a region. Upon activation of a reservation button 430 from the keyboard 6, the controller 29 instructs the patron to enter the selection code of the merchandise and a time slot for which the patron would like the merchandise to be reserved 431. The controller 29 checks to see if the patron has made the selection 432 and if so, the controller 29 asks the patron if the patron wishes to guarantee the selection 433. A selection is guaranteed by activating the "O.K." button on the keyboard 6 and if the patron chooses not to guarantee the reservation, the reservation button should be again depressed 433. Accordingly, the controller 29 checks to see if the "O.K." button has been activated 434. If so, the controller instructs the patron to insert a credit card 435. If the "O.K." button has not been activated so as to guarantee the selection, the controller 29 checks to see if the reservation button has been activated 438. If the reservation button has not been activated, the controller 29 starts a watch dog timer 441 which continues to question whether the predetermined time has expired 442 so as to watch for the patrons's response. If the time completely expires, the controller 29 exits the RESERVATION routine. If the reservation button had been activated, indicating that the reservation is not to be guaranteed, the controller 29 instructs the patron that the reservation has been made and that the patron can pick up the reserved merchandise at the selected time and date 439. The controller 29 then issues the patron a reservation number and enters the reservation into the memory 440 and exits the RESERVATION routine.

If the reservation is to be guaranteed, once the patron has inserted a credit card 435, the controller 29 stores the credit card number into the memory 436. The controller 29 then charges the reservation to the credit card and instructs the patron that the selection has been paid for and defines the date and time that the reserved merchandise can be picked up 437. The controller 29 then issues the reservation number to the patron, enters the reservation into the memory 440 and exits the RESERVATION routine.

Figure 25:
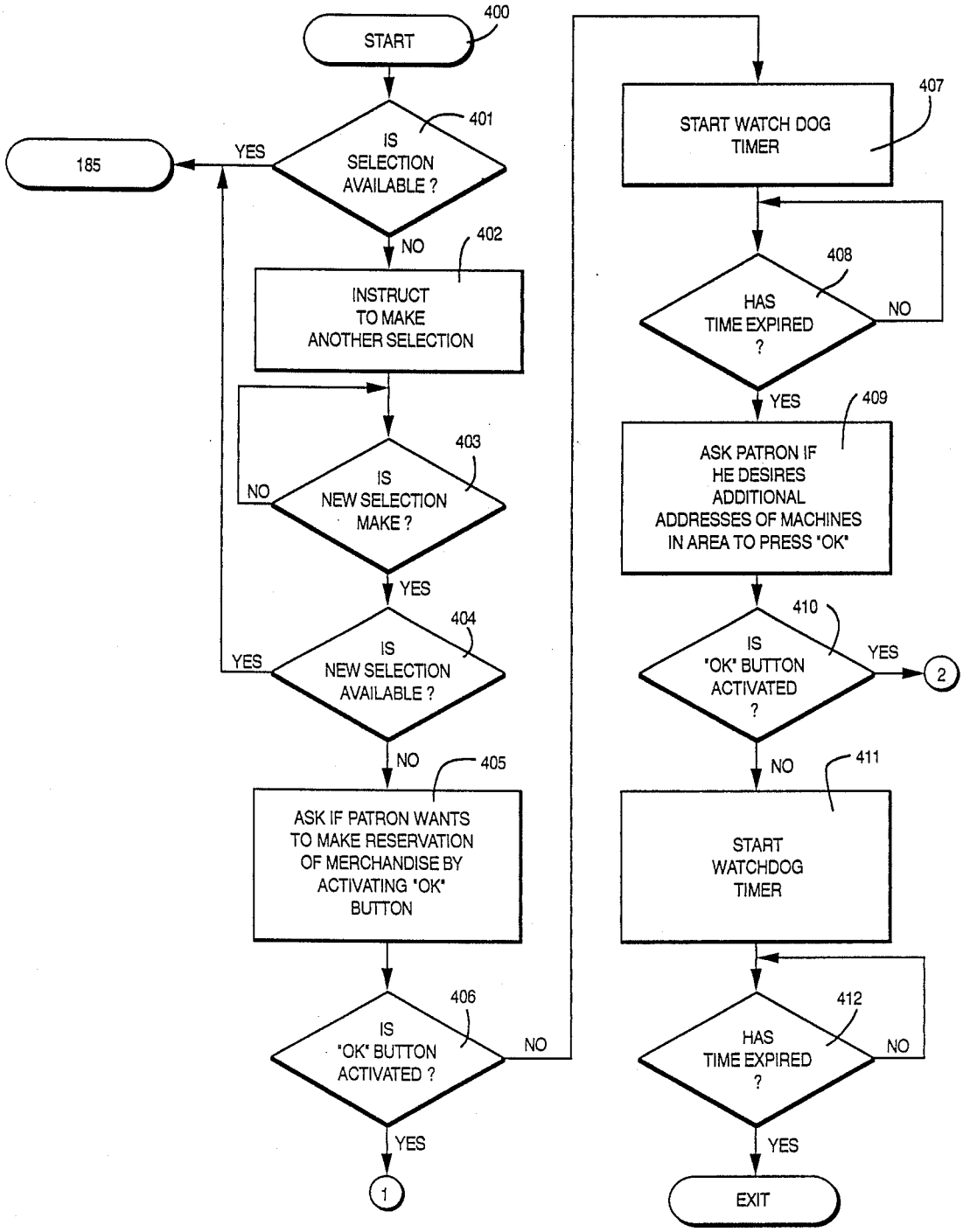
FIGS. 25, 25*a* and 25*b* are flowcharts illustrating the RESERVATION procedure of the present invention.
Figure 25A:
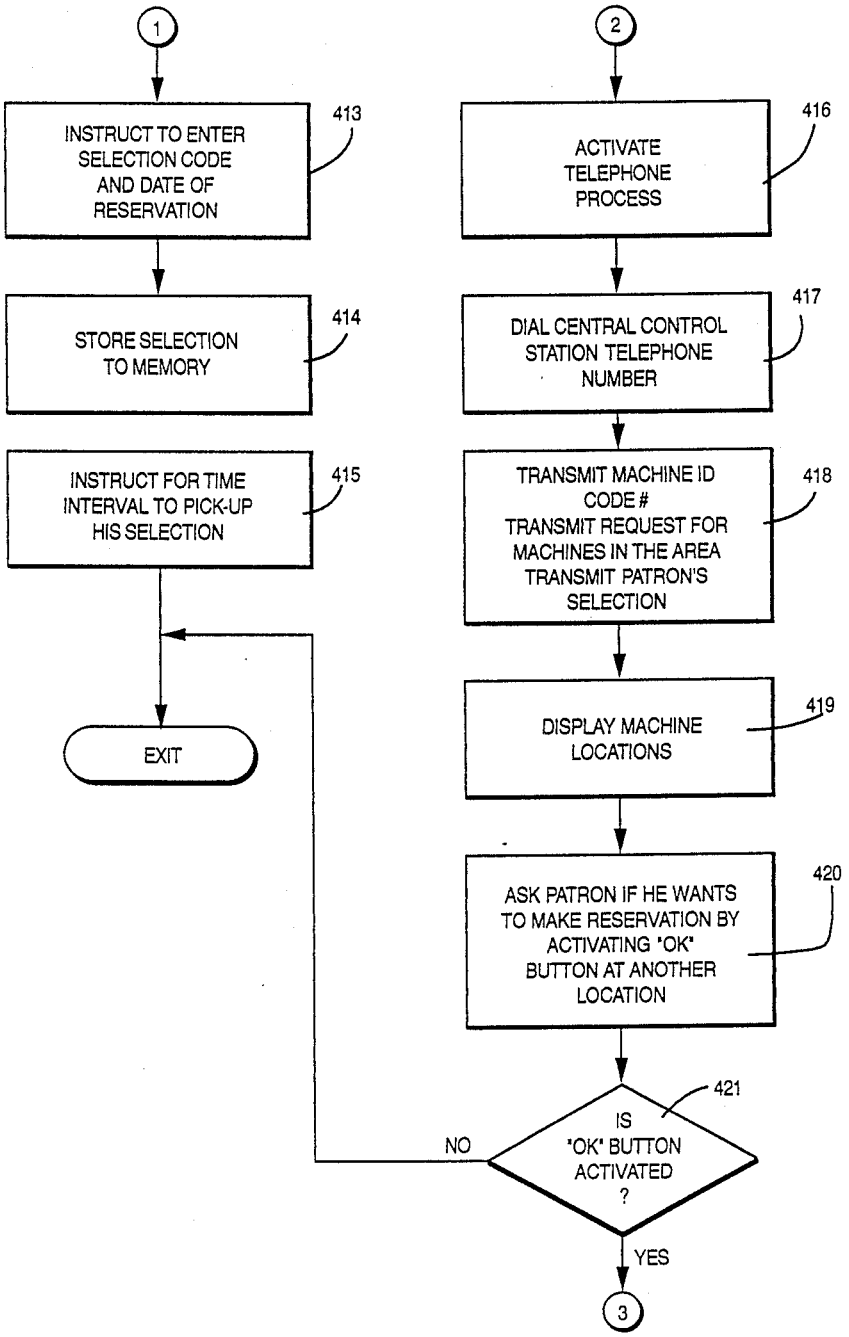
Figure 25B:
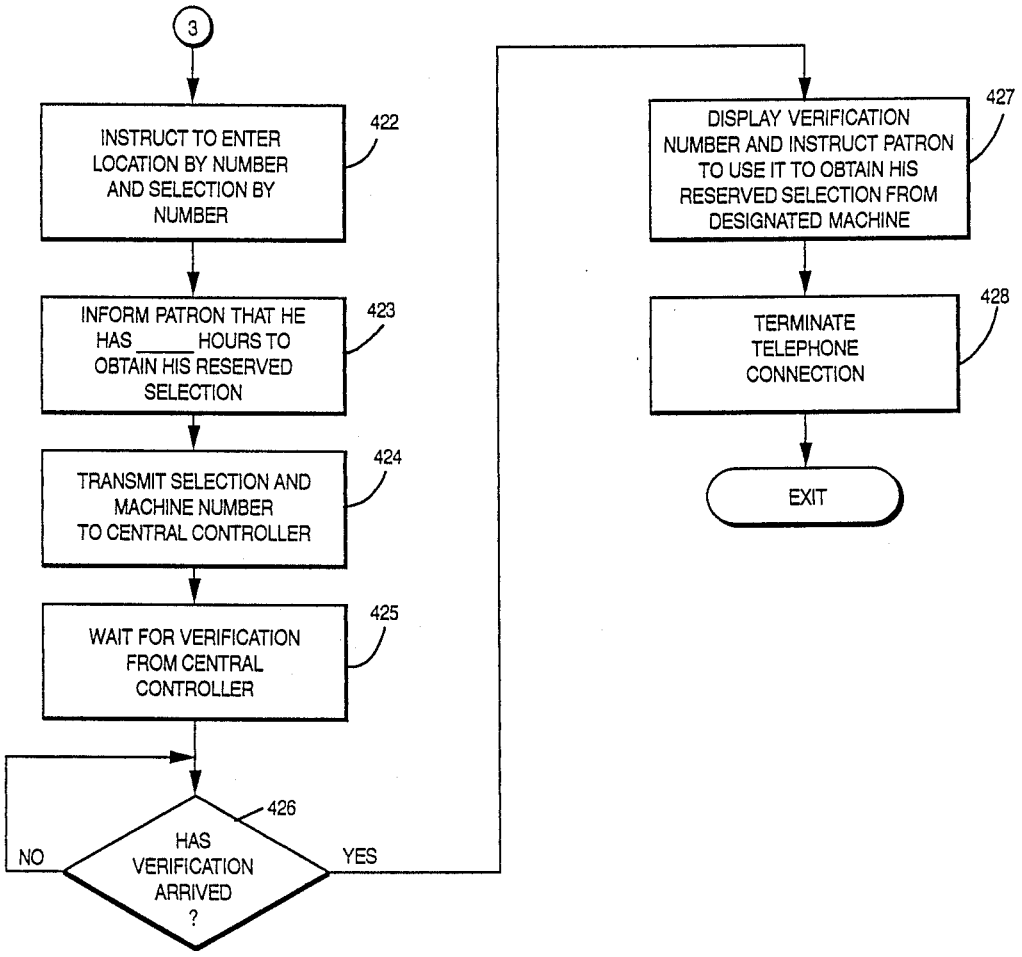

FIGS. 25, 25*a* and 25*b* show the RESERVATION procedure 398 which is performed after the patron has already entered the main procedure and which the controller 29 runs through before a RENT procedure 185 is performed. Once the patron enters a selection, the controller 29 determines whether the selection is available 401. If the selection is available, the controller 29 jumps to the rent procedure 185. However, if the selection is not available, the controller 29 instructs the patron to make another selection 402. The controller 29 then determines whether a new selection has been made 403 and if so, again determines whether the new selection is available 404. If the new selection is available, the controller 29 again jumps to the RENT procedure 185. However, if this new selection is not available, the controller 29 asks the patron if the patron wishes the make a reservation of the merchandise 405. As stated previously with respect to the RESERVATION routine, a reservation is made by activating the "O.K." button 405. Accordingly, the controller 29 then determines whether the "O.K." button has been activated. If the "O.K." button has been activated, the controlled 29 instructs the patron to enter a selection code and the date of the reservation 413. The controller 29 then stores the selection into a memory 414 and instructs the patron of the time interval at which to pick up the selected reservation 415 and exits the RESERVATION procedure. Alternatively, if the "O.K." button has not been activated, the controller 29 starts a watch dog timer 407 and determines whether this time has expired 408. If the time has not expired, the controller 29 continues to check for the expired time. However, if the time has expired, the controller 29 asks the patron if the patron desires additional addresses of machines in the area which have the selected merchandise available for reservation 409.

The desire for these additional addresses is conveyed to the controller 29 by the patron by pressing the "O.K." button. Accordingly, the controller 29 determines whether the "O.K." button has been activated 410. If the "O.K." button has not been activated, the controller 29 activates the watch dog timer 411 and waits for the patron to respond. the controller 29 continues to check whether this time has expired 412 and when it has, exits the RESERVATION procedure. If the "O.K." button has been activated, the controller 29 activates the telephone process 416 and dials the telephone number of the remote central controller station 417. The controller 29 then transmits the ID number of the machine being used, and a request for the code numbers of machines in the area which contain the patron's selection 418. Upon receiving the information relating to the other machines in the area from the main controller 443, the controller 29 displays the machine locations 419 and asks the patron if the patron desires to reserve the merchandise at one of these other locations 420.

The desire to make the reservation is conveyed to the controller 29 by activating the "O.K." button and, therefore, the controller 29 determines whether the "O.K." button has been activated 421. If not, the controller 29 exits the RESERVATION procedure. If the "O.K." button has been activated, the controller 29 instructs the patron to enter the location code of the desired machine and the selection code of the desired merchandise 422. The controller 29 then informs the patron that he has a predetermined number of hours to pick up the reserved selection 423 and transmits the selection and machine codes to the central controller 424. The controller 29 then waits for a verification from the central controller 424 and upon receiving the verification 426, displays the verification number and instructs the patron to use this number to pick up the reserved selection from the designated machine 427. The controller 29 then terminates the telephone connection 428 and exits the RESERVATION procedure.

As can be appreciated, many other functions and assorted vendings can be performed with the vending machine of the present invention due to the ability of the vending machine to store and retrieve a vast number of articles. It will also be apparent that the vending machine can be programmed to store any type of information helpful to the sales department, such as, articles vended by the hour, frequency of vended articles, successful and unsuccessful attempts for each particular items, etc. It will also be apparent that the vending machine can be programmed to call at a regularly programmed time, through modem 32 and the telephone line 110, to a remote central location having a main controller 443 and transmit all the information, data and daily transactions stored in its storage media 13, and at the same time, receive from the main controller 443 new operating instructions, such as, price changes, time to call back for reporting, etc.

Several inputs can be provided in this vending machine of the present invention in which sensors can be placed to protect the vending machine from the vandalism, burglary, etc. These sensors, upon triggering, will activate modem 32, and through line 110, will report the alarm to the remote central location. In addition, a software alarm program can also be reported through the modem 32 to the machine to a diagnostic program installed in the machine during a non-busy time to monitor the components of the system and detect which are not operating properly.

As set forth in the foregoing description, the present invention provides a mechanically and electronically simplified vending machine. The merchandise to be vended is stored on shelves arranged in a plurality of columns which are accessed by an elevator. The elevator carries service platforms and a transferring fork which transfers the merchandise to and from the storage shelves. One of the service platforms is hinged such that upon returning the elevator to the NEUTRAL position, the merchandise is dumped down a chute to the patron. Accordingly, mechanical movement is required in only two directions of the same plane to access the shelves, which allows greater storage capacity in the machine.

While we have shown and described several embodiments in accordance with the present invention, it is understood that the same is not limited thereto but is susceptible to numerous changes and modifications as apparent to one having ordinary skill in the art and we therefore do not wish to be limited to the details shown and described herein, but any modifications encompassed by the scope of the following claims.

We claim:

1. A vending machine for vending merchandise to a patron, comprising:

controller means for controlling operation of said vending machine;

display means for displaying information to said patron;

input means for inputting instructions from said patron to said controller means;

shelf means for storing said merchandise in a plurality of columns;

elevator means responsive to said controller means for moving vertically and horizontally from an original position to access a selection one of said merchandise in a predetermined column location, said elevator means returning to said original position after accessing said predetermined column location;

switch means responsive to said controller means for causing said elevator means to dispense said selected merchandise to said patron after said elevator means has returned to said original position, said switch means comprising extension means for extending into a movement path of said elevator means upon receiving a dispense command from said controller means;

wherein said elevator means comprises:

an elevator;

at least two service platforms for carrying said merchandise;

an endless drive means;

means for rotating said endless drive means in one of a clockwise and counter-clockwise direction in dependence upon the column to be accessed;

fork means connected to said endless drive means for transferring said merchandise between said shelf means and said service platforms as said means for rotating rotates in a clockwise and counter-clockwise direction; and wherein a first of said at least two service platforms is pivotably connected to said elevator and includes a portion for contacting said extension means of said switch means such that said first of said at least two service platforms tilts forward as said elevator means is raised beyond said extension means to dispense said merchandise to said patron.

2. A vending machine according to claim 1, wherein said original position comprises a NEUTRAL position, said elevator means being controlled by said controller means such that said elevator means begins an access operation from said NEUTRAL position and returns to said NEUTRAL position to dispense said merchandise, said NEUTRAL position corresponding to a vertical position where at least one of said columns has no shelf means.

3. A vending machine according to claim 1, further comprising a first motor for vertically moving said elevator and a second motor for horizontally moving said fork means along said elevator by rotating said endless drive means.

4. A vending machine according to claim 1, further comprising a single motor and gear means for vertically moving said elevator and horizontally said fork means along said elevator.

5. A vending machine according to claim 1, wherein said fork means transfers merchandise from a second of said at least two service platforms to said first of said at least two service platforms only when said elevator means is at said original position, said original position comprising a NEUTRAL position and corresponding to a vertical position wherein at least one of said columns has no shelf means.

6. A vending machine according to claim 5, wherein said elevator means further comprises detecting means for detecting when said fork means is in an alignment position with any one of said plurality of columns and said at least two service platforms, said elevator means moving vertically only when said fork means is in an alignment position.

7. A vending machine according to claim 6, wherein said detecting means comprises:

encoding means for encoding a position of said fork means with respect to one of said alignment positions; and counter means for counting said alignment positions as said fork means moves with respect thereto and for outputting a position signal to said controller means based on said count.

8. A vending machine according to claim 6, wherein said detecting means comprises:

a plurality of switching means positioned along said elevator means for providing signals when said fork means is in contact therewith; and encoding means for encoding said signals from said plurality of switching means and for outputting an encoded signal to said controller means corresponding to a position of said fork means along said elevator means.

9. A vending machine according to claim 8, wherein each of said shelf means is fashioned as a preformed injected molded plastic member including a retaining means for retaining the merchandise thereon.

10. A vending machine according to claim 1, wherein said merchandise comprises video cassette tapes.

11. A vending machine according to claim 1, wherein said merchandise comprises photographic materials.

12. A vending machine according to claim 1, wherein said merchandise comprises both video cassette tapes and photographic materials.

13. A vending machine according to claim 1, further comprising means for allowing communication between said patron and a main controller located at a remote location from said vending machine, such that said patron can receive assistance from one of said main controller and an operator thereat.

14. A vending machine according to claim 7, wherein said means for allowing communication comprises a telephone system.

15. A vending machine according to claim 1, further comprising means for allowing said patron to reserve merchandise for vending at a predetermined time.

16. A vending machine according to claim 1, further comprising basket means for accepting merchandise into said vending machine and means for inputting merchandise to said basket means in response to an input signal from said patron.

17. A vending machine according to claim 1, wherein said endless drive means comprises an endless belt.

18. A vending machine for vending merchandise to a patron, comprising:

controller means for controlling operation of said vending machine;

display means for displaying information to said patron;

input means for inputting instructions from said patron to said controller means;

shelf means for storing said merchandise in a plurality of columns;

elevator means responsive to said controller means for moving vertically and horizontally from an original position to access a selected one of said merchandise in a predetermined column location, said elevator means returning to said original position after accessing said predetermined column location;

switch means responsive to said controller means for causing said elevator means to dispense said selected merchandise to said patron after said elevator means has returned to said original position, said switch means comprising extension means for extending into a movement path of said elevator means upon receiving a dispense command from said controller means;

wherein said elevator means comprises:

an elevator;

at least two service platforms for carrying said merchandise;

an endless drive means;

means for rotating said endless drive means in one of a clockwise and counter-clockwise direction in dependence upon the column to be accessed;

fork means connected to said endless drive means for transferring said merchandise between said shelf means and said service platforms as said means for rotating rotates in a clockwise and counter-clockwise direction;

wherein said fork means transfers merchandise from a second of said at least two service platforms to a first of said at least two service platforms only when said elevator means is at said original position, said original position comprising a NEUTRAL position and corresponding to a vertical position wherein at least one of said columns has no shelf means; and at least one transfer platform disposed in said NEUTRAL position such that said fork means transfers said merchandise from said second of said at least two service platforms to said first of said at least two service platforms across said at least one transfer platform.

19. A vending machine for vending merchandise to a patron, comprising:

controller means for controlling operation of said vending machine;

display means for displaying information to said patron;

input means for inputting instructions from said patron to said controller means;

shelf means for storing said merchandise in a plurality of columns;

elevator means responsive to said controller means for moving vertically and horizontally from an original position to access a selected one of said merchandise in a predetermined column location, said elevator means returning to said original position after accessing said predetermined column location;

switch means responsive to said controller means for causing said elevator means to dispense said selected merchandise to said patron after said elevator means has returned to said original position, said switch means comprising extension means for extending into a movement path of said elevator means upon receiving a dispense command from said controller means;

wherein said elevator means comprises:

an elevator;

at least two service platforms for carrying said merchandise;

an endless drive means;

means for rotating said endless drive means in one of a clockwise and counter-clockwise direction in dependence upon the column to be accessed;

fork means connected to said endless drive means for transferring said merchandise between said shelf means and said service platforms as said means for rotating rotates in a clockwise and counter-clockwise direction; and an input port for allowing said patron to insert said merchandise into said vending machine when returning said merchandise;

a code reader means for scanning said merchandise upon return for identifying said merchandise;

means for moving said merchandise from said input port to a first of said at least two service platforms of said elevator means after said merchandise has been identified; and wherein said code reader means comprises:

a bar-code reader for reading a bar-code disposed on said merchandise; and a roller means for pushing said merchandise back and forth adjacent to said bar-code reader a plurality of times so that said bar-code on said merchandise can be properly scanned.

20. A vending machine according to claim 19, further comprising means for allowing merchandise from a different vending machine to be returned to said vending machine.

21. A vending machine according to claim 19, wherein said input port is dimensioned so as to allow a plurality of merchandise to be inserted into said vending machine at one time.

22. A plurality of vending machines for vending merchandise to a patron, each of said plurality of vending machines comprising:

controller means for controlling operation of said vending machine;

display means for displaying information to said patron;

input means for inputting instructions from said patron to said controller means;

shelf means for storing said merchandise in a plurality of columns;

elevator means responsive to said controller means for moving vertically and horizontally from an original position to access a selected one of said merchandise in a predetermined column location, said elevator means returning to said original position after accessing said predetermined column location;

switch means responsive to said controller means for causing said elevator means to dispense said selected merchandise to said patron after said elevator means has returned to said original position, said switch means comprising extension means for extending into a movement path of said elevator means upon receiving a dispense command from said controller means;

wherein said elevator means comprises: an elevator;

at least two service platforms for carrying said merchandise;

an endless drive means;

means for rotating said endless drive means in one of a clockwise and counter-clockwise direction in dependence upon the column to be accessed;

fork means connected to said endless drive means for transferring said merchandise between said shelf means and said service platforms as said means for rotating rotates in a clockwise and counter-clockwise direction;

wherein a first of said at least two service platforms is pivotably connected to said elevator and includes a portion for contacting said extension means of said switch means such that said first of said at least two service platforms tilts forward as said elevator means is raised beyond said extension means to dispense said merchandise to said patron; and wherein said plurality of vending machines are all connected to a remote main controller at a remote location for providing instructions and data transfer between any of said plurality of vending machines so as to communicate with each of said plurality of vending machines from said remote location.

23. A plurality of vending machines according to claim 22, wherein said controller means of each of said plurality of vending machines communicates with said remote main controller so as to allow a patron at a first vending machine to reserve merchandise at any other one of said plurality of vending machines.

24. A vending machine for vending merchandise to a patron, comprising:

controller means for controlling operation of said vending machine;

display means for displaying information to said patron;

input means for inputting instructions from said patron to said controller means;

at least two sets of columns of shelf means for storing said merchandise;

at least two elevator means, each for accessing a respective one of said at least two sets of columns of shelf means, said at least two elevator means being interconnected such that as one of said at least two elevator means moves in one vertical direction, the other of said at least two elevator means moves in an opposite vertical direction;

at least two switch means responsive to said controller means for causing a respective one of said at least two elevator means to dispense said merchandise to said patron;

wherein each of said at least two switch means comprises extension means for extending into a movement path of a respective one of said at least two elevator means upon receiving a dispense command from said controller means; and wherein each of said at least two elevator means comprises:

at least two elevators;

at least two service platforms for carrying said merchandise;

an endless drive means;

means for rotating said endless drive means in one of a clockwise and counter-clockwise direction based on the column to be accessed; and fork means connected to said endless drive means for transferring said merchandise between said shelf means and said service platforms as said means for rotating rotates in the clockwise and counter-clockwise directions.

25. A vending machine according to claim 24, wherein a first one of said at least two service platforms is pivotably connected to a corresponding one of said at least two elevators and includes a portion for contacting said extension means of a respective one of at least two said switch means such that said first of said at least two service platforms tilts forward as a respective one of said at least two elevator means rises beyond said extension means to dispense said merchandise to said patron.

26. A vending machine according to claim 25, further comprising a first vertical motor means for moving said at least two elevators vertically and at least one horizontal motor means for moving each of said fork means horizontally along a respective one of said at least two elevators.

27. A vending machine according to claim 24, further comprising a single motor means and gear means for moving said at least two elevators vertically and for moving each fork means horizontally along a respective one of said at least two elevators.

28. A vending machine according to claim 25, wherein each of said fork means transfers merchandise from a second one of said at least two service platforms to said first one of said at least two service platforms only when a corresponding one of said at least two elevator means is at an original position, said original position comprising a NEUTRAL position and corresponding to a vertical position in each of said at least two sets of columns of shelf means where at least one of said columns has no shelf means.

29. A vending machine according to claim 28, further comprising at least one transfer platform disposed in said NEUTRAL position of each set of columns of shelf means such that each of said fork means transfers said merchandise from said second of said at least two service platforms to said first of said at least two service platforms across said at least one transfer platform.

30. A vending machine according to claim 24, wherein each of said at least two elevator means further comprises detecting means for detecting when said fork means corresponding thereto is in an alignment position with one of said columns and said at least two service platforms, each of said at least two elevator means moving vertically only when said fork means is in an alignment position.

31. A vending machine according to claim 30, wherein each of said detecting means comprises:

encoding means for encoding a position of said fork means with respect to one of said alignment positions; and counter means for counting said alignment positions as said fork means moves with respect thereto and for outputting a position signal to said controller means based on said count.

32. A vending machine according to claim 30, wherein each of said detecting means comprises:

a plurality of switching means positioned along a respective one of said at least two elevator means for providing signals when said fork means is in contact therewith; and encoding means for encoding said signals from said plurality of switching means and for outputting an encoded signal to said controller means corresponding to a position of said fork means along said respective one of said at least two elevators.

33. A vending machine according to claim 32, wherein each of said shelf means is fashioned as a preformed injected molded plastic member including a retaining means for retaining the merchandise thereon.

34. A vending machine according to claim 33, wherein said merchandise comprises video cassette tapes.

35. A vending machine according to claim 33, wherein said merchandise comprises photographic materials.

36. A vending machine according to claim 24, wherein said merchandise comprises both video cassette tapes and photographic materials.

37. A vending machine according to claim 24, further comprising means for allowing communication between said patron and a main controller located at a remote location for said vending machine, such that said patron can receive assistance from one of said main controller and an operator thereat.

38. A vending machine according to claim 37, wherein said means for allowing communication comprises a telephone system.

39. A vending machine according to claim 24, wherein said controller means includes means for allowing said patron to reserve merchandise for vending at a predetermined time.

40. A vending machine according to claim 24, further comprising basket means for accepting merchandise into said vending machine and means for inputting merchandise to said basket means in response to an input signal from said patron.

41. A vending machine according to claim 24, wherein said means for rotating comprises an endless belt.

42. A vending machine according to claim 24, further comprising an input port which is dimensioned so as to allow a plurality of merchandise to be inserted into said vending machine at one time.

43. A vending machine for vending merchandise to a patron, comprising:

controller means for controlling operation of said vending machine;

display means for displaying information to said patron;

input means for inputting instructions from said patron to said controller means;

at least two sets of columns of shelf means for storing said merchandise;

at least two elevator means, each for accessing a respective one of said at least two sets of columns of shelf means, said at least two elevator means being interconnected such that as one of said at least two elevator means moves in one vertical direction, the other of said at least two elevator means moves in an opposite vertical direction;

at least two switch means responsive to said controller means for controlling a respective one of said at least two elevator means to dispense said merchandise to said patron;

an input port for allowing said patron to insert said merchandise into said vending machine when returning said merchandise;

a code reader means for scanning said merchandise upon return for identifying said merchandise;

means for moving said merchandise from said input port to a first service platform of the proper one of said at least two elevator means which corresponds to a storage location of said merchandise in said vending machine;

wherein said code reader means comprises:

a bar-code reader for reading a bar-code disposed on said merchandise; and a roller for pushing said merchandise back and forth adjacent to said bar-code reader a plurality of times so that said bar-code on said merchandise can be properly scanned.

44. A plurality of vending machines for vending merchandise to a patron, each of said plurality of vending machines comprising:

controller means for controlling operation of said vending machine;

display means for displaying information to said patron;

input means for inputting instructions from said patron to said controller means;

at least two sets of columns of shelf means for storing said merchandise;

at least two elevator means, each for accessing a respective one of said at least two sets of columns of shelf means, said at least two elevator means being interconnected such that as one of said at least two elevator means moves in one vertical direction, the other of said at least two elevator means moves in an opposite vertical direction;

at least two switch means responsive to said controller means for causing a respective one of said at least two elevator means to dispense said merchandise to said patron;

wherein each of said at least two switch means comprises extension means for extending into a movement path of a respective one of said at least two elevator means upon receiving a dispense command from said controller means; and wherein each of said at least two elevator means comprises:

at least two elevators;

at least two service platforms for carrying said merchandise;

an endless drive means;

means for rotating said endless drive means in one of a clockwise and counter-clockwise direction based on the column to be accessed;

fork means connected to said endless drive means for transferring said merchandise between said shelf means and said service platforms as said means for rotating rotates in the clockwise and counter-clockwise directions;

wherein said plurality of vending machines are all connected to a remote main controller at a remote location for providing instructions and data transfer between any of said plurality of vending machines so as to communicate with each of said plurality of vending machines from said remote location.

45. A plurality of vending machines connected to a remote main controller according to claim 44, wherein said controller means of each of said plurality of vending machines communicates with said main controller so as to allow a patron at a first vending machine to reserve merchandise at any other one of said plurality of vending machines.

46. A method of automatically vending photographic materials from a vending machine to a patron comprising the steps of:

dispensing a coded container to said patron such that undeveloped photographic material can be placed therein;

returning said coded container to said vending machine upon insertion of said undeveloped material;

storing said coded container at a location in said vending machine corresponding to said code;

dispensing said coded container including said photographic material to a photographic material developer so that said photographic material can be developed;

returning said coded container including the developed photographic material to said vending machine;

storing said coded container including the developed photographic material at the location in said vending machine corresponding to said code;

dispensing said coded container including the developed photographic material to said patron such that said developed photographic material can be taken from said coded container by said patron;

returning said coded container to said vending machine; and storing said coded container at the location in said vending machine.

47. A vending machine for vending merchandise to a patron, comprising:

controller means for controlling operation of said vending machine;

display means for displaying information to said patron;

input means for inputting information from said patron to said controller means;

shelf means for storing merchandise in a plurality of columns;

at least one service platform for carrying said merchandise;

fork means for partially surrounding a selected one of said merchandise and transferring said selected merchandise between said shelf means and said at least one service platform;

drive means responsive to said controller means for moving said service platform vertically adjacent at least one column of said shelf means and for moving said fork means vertically and horizontally only in a plane in which said service platform is moved, wherein said fork means is movable horizontally relative to said service platform between at least two positions, a first of said at least two positions being aligned with said shelf means and a second of said at least two positions being aligned with said service platform adjacent said at least one column; and switch means responsive to said controller means for causing said service platform to dispense said selected merchandise to said patron.

48. A vending machine according to claim 47, wherein said merchandise is video cassette tapes.

49. A vending machine according to claim 47, wherein said shelf means comprises a plurality of pairs of columns and a service platform is provided between adjacent columns of each pair of columns.

50. A vending machine according to claim 47, further comprising at least one retaining belt for retaining said merchandise on said shelf means.

51. A vending machine according to claim 50, wherein a retaining belt is provided for each column of said plurality of columns, each retaining belt being fastened at one end of said at least one service platform and at another end to a fastening means above and separated from said at least one service platform by a gap through which said merchandise can pass, and being guided by rollers so as to partially surround a selected column.

52. A vending machine according to claim 47, wherein said switch means is responsive to said controller means for causing said service platform to tilt so as to drop said merchandise from said service platform.

53. A method for automatic vending of merchandise to a patron from a vending machine which stores said merchandise on shelf means in a plurality of columns which comprises:

selecting an item of merchandise;

determining a location of the selected merchandise;

moving a fork means horizontally from an original fork position aligned with a service platform adjacent one of said plurality of columns to a second position aligned with a column in which said selected merchandise is located;

simultaneously moving said fork means and a predetermined service platform which is adjacent said column in which said selected merchandise is located vertically from an original vertical position to a third position wherein said fork means partially surrounds said selected merchandise at said location and said predetermined service platform is adjacent said selected merchandise;

moving said fork means horizontally to a fourth position such that said fork means is aligned with said predetermined service platform so as to transfer said selected merchandise from said shelf means to said predetermined service platform;

simultaneously moving said fork means and said service platform vertically to said original vertical position; and tilting said service platform to dispense said selected merchandise to said patron.

54. A method according to claim 53, wherein said fork means is returned with said selected merchandise to the original fork position before tilting said service platform.

55. A method for automatic returning of selected merchandise to a vending machine which stores said merchandise on shelf means in a plurality of columns which comprises:

providing fork means aligned with a service platform at an original position;

inserting said selected merchandise into said vending machine;

scanning said selected merchandise to identify said selected merchandise;

detecting an empty location within one column of said shelf means;

moving said selected merchandise to a predetermined service platform so as to be surrounded by said fork means aligned with said predetermined service platform adjacent said one column at a first vertical level;

simultaneously moving said predetermined service platform, said selected merchandise and said fork means vertically so as to be adjacent said empty location;

moving said fork means horizontally to a position aligned with said one column so as to transfer said selected merchandise from said predetermined service platform to said empty location of said shelf means;

storing the location and identity of said selected merchandise;

simultaneously moving said fork means and said predetermined service platform vertically to said first vertical level; and moving said fork means to said original position.

56. A method according to claim 55, wherein said empty location is an empty location which is closest to a location at which said selected merchandise is inserted in said vending machine.

* * * * *